US006213592B1

(12) United States Patent
Takenouchi et al.

(10) Patent No.: US 6,213,592 B1
(45) **Date of Patent: *Apr. 10, 2001**

(54) METHOD FOR DISCHARGING INK FROM A LIQUID JET RECORDING HEAD HAVING A FLUID RESISTANCE ELEMENT WITH A MOVABLE MEMBER, AND HEAD, HEAD CARTRIDGE AND RECORDING APPARATUS USING THAT METHOD

(75) Inventors: Masanori Takenouchi, Yokohama; Makiko Kimura, Sagamihari; Toshio Kashino, Chigasaki; Takeshi Okazaki, Sagamihari; Aya Yoshihira; Kiyomitsu Kudo, both of Yokohama; Yoshie Asakawa, Hotaka-machi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/870,318

(22) Filed: Jun. 6, 1997

(30) Foreign Application Priority Data

Jun. 7, 1996 (JP) ..... 8-145940

(51) Int. Cl.[7] ..... B41J 2/05
(52) U.S. Cl. ..... 347/65; 347/48
(58) Field of Search ..... 347/65, 63, 67, 347/48, 94, 54

(56) References Cited

U.S. PATENT DOCUMENTS

| | | | |
|---|---|---|---|
| 4,412,224 | 10/1983 | Sugitani | 347/65 |
| 4,417,251 | 11/1983 | Sugitani | 347/65 |
| 4,437,100 | 3/1984 | Sugitani et al. | 347/65 |
| 4,450,455 | 5/1984 | Sugitani et al. | 347/45 |
| 4,480,259 | 10/1984 | Kruger et al. | 347/63 |
| 4,487,662 | 12/1984 | Fischbeck | 204/15 |
| 4,494,128 * | 1/1985 | Vaught | 347/98 |
| 4,496,960 | 1/1985 | Fischbeck | 347/68 |
| 4,509,063 | 4/1985 | Sugitani et al. | 347/65 |
| 4,521,787 | 6/1985 | Yokota et al. | 347/65 |
| 4,558,333 | 12/1985 | Sugitani et al. | 347/65 |
| 4,568,953 | 2/1986 | Aoki et al. | 347/65 |

(List continued on next page.)

FOREIGN PATENT DOCUMENTS

| | | | |
|---|---|---|---|
| 0160463 | 11/1985 | (EP) | B41J/3/04 |
| 0 326 428 | 8/1989 | (EP) | B41J/3/04 |
| 0436047 | 7/1991 | (EP) | B41J/2/05 |
| 0443798 | 8/1991 | (EP) . | |
| 0496533 | 7/1992 | (EP) . | |

(List continued on next page.)

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A method for discharging ink from a discharge port using a liquid jet recording head having the discharge port for discharging liquid, a liquid flow path communicating with the discharge port, a liquid discharge heat generating element provided in the liquid flow path to apply thermal energy for discharging the liquid to the liquid with bubble generation and a fluid resistance element provided upstream of the liquid discharge heat generating element in the liquid flow path. A bubble generating region is used as the fluid resistance element and a movable member is provided facing the bubble generating region and having a free end, the movable member being shiftable upon bubble generation at the region. The method includes the step of generating a bubble by driving the liquid discharge heat generating element and generating the bubble and shifting the movable member by the fluid resistance element. Also discloses are a liquid discharge head, head cartridge, and recording apparatus which perform the method.

22 Claims, 12 Drawing Sheets

U.S. PATENT DOCUMENTS

| | | | | |
|---|---|---|---|---|
| 4,609,427 | | 9/1986 | Inamoto et al. | 216/27 |
| 4,611,219 | | 9/1986 | Sugitani et al. | 347/40 |
| 4,646,120 | | 2/1987 | Ikeda et al. | 257/184 |
| 4,666,823 | | 5/1987 | Yokota et al. | 430/320 |
| 4,698,645 | | 10/1987 | Inamoto | 347/65 |
| 4,723,129 | | 2/1988 | Endo et al. | 347/56 |
| 4,723,136 | | 2/1988 | Suzumura | 347/65 |
| 4,963,883 | * | 10/1990 | Matsui | 347/48 |
| 4,994,825 | | 2/1991 | Saito et al. | 347/63 |
| 5,095,321 | | 3/1992 | Saito et al. | 347/63 |
| 5,208,604 | | 5/1993 | Watanabe et al. | 347/47 |
| 5,262,802 | | 11/1993 | Karita et al. | 347/87 |
| 5,278,585 | | 1/1994 | Karz et al. | 347/65 |
| 5,296,875 | | 3/1994 | Suda | 347/93 |
| 5,389,957 | | 2/1995 | Kimura et al. | 347/20 |
| 5,485,184 | | 1/1996 | Nakagomi et al. | 347/63 |
| 5,754,201 | * | 5/1998 | Ishinaga | 347/62 |
| 5,821,962 | * | 10/1998 | Kudo | 347/65 |
| 5,838,351 | * | 11/1998 | Weber | 347/85 |

FOREIGN PATENT DOCUMENTS

| | | | | |
|---|---|---|---|---|
| 0538147 | | 4/1993 | (EP) . | |
| 61-59914 | | 2/1980 | (JP) . | |
| 55-81172 | | 6/1980 | (JP) . | |
| 55-100169 | | 7/1980 | (JP) | B41J/3/04 |
| 58-42466 | | 11/1983 | (JP) | B41J/3/04 |
| 59-199256 | | 11/1984 | (JP) | B41J/3/04 |
| 61-69467 | | 4/1986 | (JP) . | |
| 61-110557 | | 5/1986 | (JP) . | |
| 62-156969 | | 7/1987 | (JP) . | |
| 62-169657 | * | 7/1987 | (JP) | B41J/3/04 |
| 62-225364 | * | 10/1987 | (JP) | B41J/3/04 |
| 62-240558 | | 10/1987 | (JP) | B41J/3/04 |
| 62-48585 | | 10/1987 | (JP) | B41J/3/04 |
| 63-28654 | | 2/1988 | (JP) | B41J/3/04 |
| 62-102945 | | 5/1988 | (JP) | B41J/3/04 |
| 63-102944 | | 5/1988 | (JP) | B41J/3/04 |
| 63-151459 | * | 6/1988 | (JP) | B41J/3/04 |
| 63-197652 | | 8/1988 | (JP) | B41J/3/04 |
| 63-199972 | | 8/1988 | (JP) | B41J/3/04 |
| 2-113950 | | 4/1990 | (JP) . | |
| 3-81155 | | 4/1991 | (JP) . | |
| 4-118248 | | 4/1992 | (JP) | B41J/2/05 |
| 5-124189 | | 5/1993 | (JP) | B41J/2/05 |
| 5-229122 | | 9/1993 | (JP) | B41J/2/05 |
| 6-31918 | | 2/1994 | (JP) | B41J/2/05 |
| 6-87214 | | 3/1994 | (JP) . | |

* cited by examiner

FIG. 20 - PRIOR ART
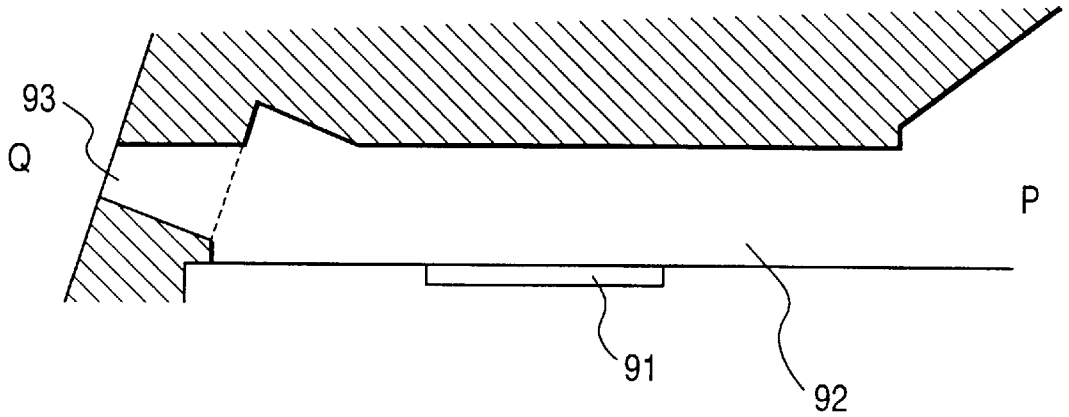
FIG. 21 - PRIOR ART
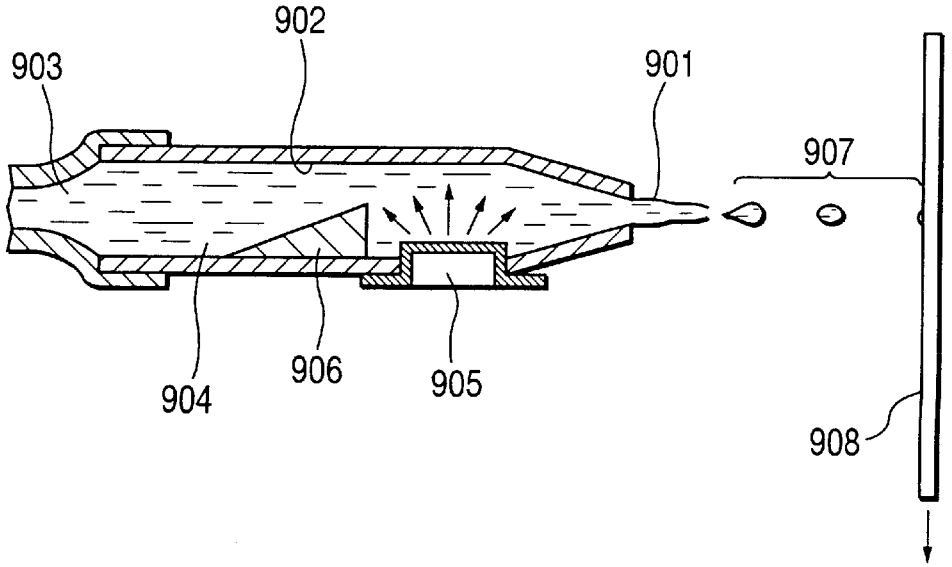

FIG. 22A - PRIOR ART
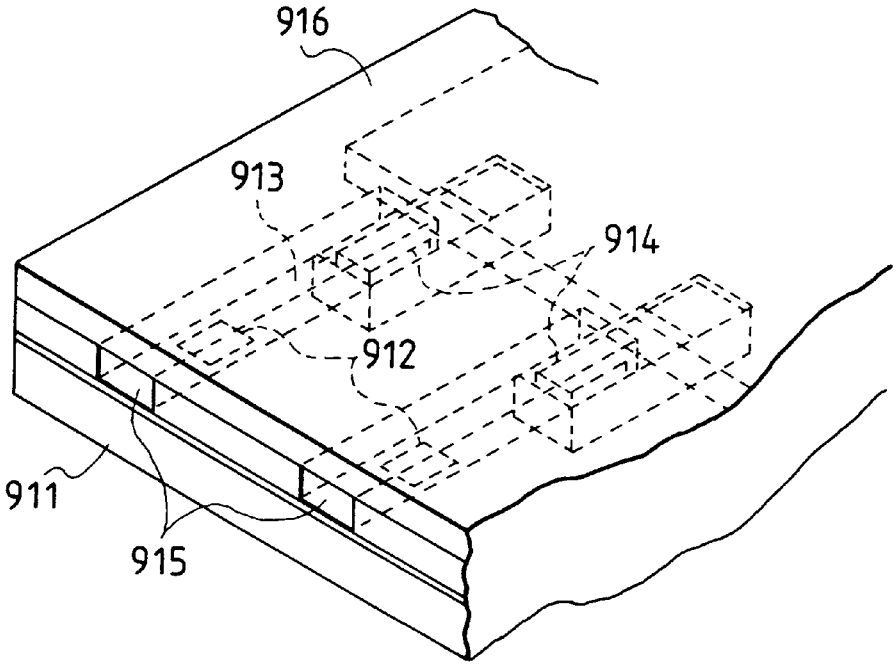
FIG. 22B - PRIOR ART
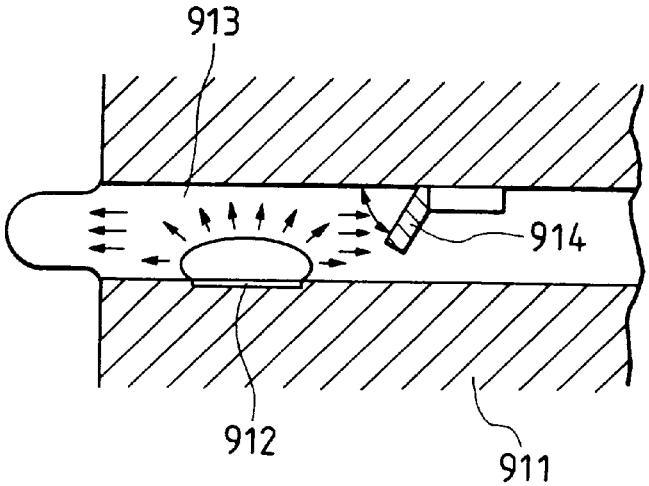

METHOD FOR DISCHARGING INK FROM A LIQUID JET RECORDING HEAD HAVING A FLUID RESISTANCE ELEMENT WITH A MOVABLE MEMBER, AND HEAD, HEAD CARTRIDGE AND RECORDING APPARATUS USING THAT METHOD

BACKGROUND OF THE INVENTION

1. Field of the Invention

This invention relates to a liquid discharging method typified by an ink jet recording method of discharging liquid droplets, a liquid discharging head typified by an ink jet recording head, a liquid discharging head cartridge and an ink jet recording apparatus.

2. Related Background Art

An ink jet recording method of discharging minutes ink droplets from a nozzle (discharge port) to thereby effect the recording of characters, figures, etc. has been attracting attention as a recording method in an apparatus for effecting recording, such as a printer, a copying apparatus, a facsimile apparatus or a plotter. The ink jet recording method has the excellent advantage that the outputting of highly minute images and high-speed printing are possible. Particularly, a method of producing air bubbles in liquid by an electro-thermal converting member (hereinafter also referred to as the heater) and using this produced bubble pressure, i.e., the so-called bubble jet method, is characterized in that the downsizing of the apparatus and the higher density of image are easy to realize.

Now, the liquid discharged from the nozzle by the bubble pressure is not limited to ink liquid, but it is possible to discharge other liquids. So, herein, a method of discharging not only ink, but generally liquids is called the liquid discharging method, and in the liquid discharging method, a method of discharging ink liquid to a recording medium to thereby effect recording is called the ink jet recording method.

In the field of ink jet recording, the requirement for the coloring of recording is high. As the construction of an ink jet recording apparatus which satisfies the requirement for the coloring, there is adopted, for example, one in which color recording is effected with ink jet recording heads of various colors are arranged in parallel along the scanning direction on a carriage, or one in which color ink jet recording heads comprising ink tanks containing therein yellow, magenta and cyan inks used for color recording and recording heads for discharging these inks, the ink tanks and the recording heads being arranged in parallel so as to make a unit, and a single ink jet recording head for black only are disposed on a carriage and color recording is effected.

FIG. 20 of the accompanying drawings is a schematic cross-sectional view of the ink flow path portion of a recording head of the conventional bubble jet type using an electro-thermal converting member to produce air bubbles to thereby discharge ink liquid droplets. A heater portion 91 is embedded in an ink flow path 92, one end of which communicates with a discharge port 93, and the ink flow path 92 is filled with ink. Heat produced by the heater portion 91 acts on the ink filling the ink flow path 92, whereby the ink on the heater portion 91 causes a sudden state change (bubbling phenomenon) and some of the ink in the ink flow path 92 is discharged and flies from the discharge port 93 to a recording medium, whereby recording is effected. The bubble produced by the heat generation of the heater portion 91 shrinks and disappears when the heating by the heater portion 91 ends, and the ink flow path 92 again becomes filled with ink (the ink refill process).

However, in the conventional recording head as shown in FIG. 20, the bubble produced may become larger than necessary and in such case, much time is required for the disappearance of the bubble. Also, at the same time as the energy during bubbling is transmitted from the heater portion 91 toward the discharge port 93 (in Q direction), the energy is greatly transmitted toward the upstream side (in P direction) which is the ink supply side and therefore, there is the problem to be solved that much time is required for refilling the ink flow path 92 with the ink. A pressure wave propagated to the upstream side with the production of the air bubble is herein called a back wave.

The recording head of such flow path construction as shown in FIG. 20 could coped with the printing speed in the recording apparatus as is conventional, but in the recent recording apparatus wherein higher speed recording is desired, the ink refill time has been not enough for the printing speed and in some cases, the non-discharge of the ink has occurred.

Also, in an ordinary ink jet recording head, a common ink chamber for supplying ink to a plurality of ink flow paths is provided upstream of the flow paths, but when such a back wave is strongly transmitted to the upstream side of the ink, this back wave may be propagated to other ink flow path through the common liquid chamber and may adversely affect the discharged state of the ink in that flow path.

The above-noted facts that much refill time is required and that there is the adverse effect of the back wave have been problems to be solved that generally apply to liquid discharging heads utilizing air bubbles to discharge liquid droplets.

Various propositions have heretofore been made in order to solve such problems. Description will hereinafter be made of propositions made to an ink jet recording head, and it is apparent that the following construction is generally applicable to liquid discharging heads.

For example, as described in Japanese Laid-Open Patent Application No. 55-100169, there is known a construction in which a fluid resistance portion is provided upstream of a heater portion in an ink flow path for generating heat energy. The structure of such ink jet recording head is shown in FIG. 21 of the accompanying drawings. As shown in FIG. 21, ink 904 flows from an inlet opening 903 at one end of an ink flow path 902 into the ink flow path 902 communicating with a discharge port 901 for discharging the ink. Near the discharge port 901 at the other end of the ink flow path 902, a heater 905 for generating heat energy utilized to form air bubbles and discharge the ink is disposed on a wall surface, and a barrier 906 is protrudingly provided on the upstream side (the inlet opening 903 side) of the heater 905 on the wall surface on which this heater 905 is disposed. In such recording head, when an electrical signal is inputted to the heater 905, an air bubble is produced in the ink 904 and by the action thereof, ink droplets 907 are discharged from the discharge port 901 toward a recording medium 908. At the same time, the acting force of the air bubble acts also in the anti-discharging direction (the direction toward the inlet opening 903), but due to the barrier 906 provided in the anti-discharging direction, the fluid resistance in the anti-discharging direction becomes greater than the fluid resistance in the discharging direction, and the acting force of the air bubble is effectively utilized for the discharging of the ink droplets 907.

Also, as a method of preventing the loss of energy toward the upstream side of such a heater, there is disclosed in Japanese Laid-Open Patent Application No. 59-199256 a method of providing, besides discharge energy generating means directly concerned in the discharge, second energy generating means which is not directly concerned in the discharge. By using the second energy generating means, the loss of the energy generated by the discharge energy generating means toward the upstream side is prevented.

Also, in Japanese Laid-Open Patent Application No. 62-240558, there is disclosed a method of providing heating means in a liquid chamber, in addition to the heater arrangement of Japanese Laid-Open Patent Application No. 59-199256.

In Japanese Laid-Open Patent Application No. 63-102945, there is disclosed structure in which discretely from a discharge heater for controlling discharge, second energy generating means is provided so as to be orthogonal to a flow path so that the component in the direction of the flow path width of this second energy generating means may become greater than the flow path width.

Further, Japanese Laid-Open Patent Application No. 63-197652 or Japanese Laid-Open Patent Application No. 63-199972 discloses that a valve mechanism is utilized as a fluid resistance element to prevent the loss of discharge energy. The flow path structure disclosed in these publications is that shown in FIGS. 22A and 22B of the accompanying drawings. In this recording head, an electro-thermal converting member 912 for forming air bubbles is provided on a substrate 911 correspondingly to each ink flow path 913, and one end of each ink flow path 913 is a discharge port 915 and the other end thereof is connected in common to a common liquid chamber 916. A valve mechanism 914 has such an initial position that sticks on the ceiling of the ink flow path 913, is provided upstream of a heat acting area near the electro-thermal converting member 912 (the projection space toward the surface of the electro-thermal converting member) with respect to the direction of flow of ink, and is structured to be opened by a back wave. This recording head is designed to operate the valve mechanism 914 so as to prevent the propagation of the back wave toward the more upstream side, thereby preventing the loss of discharge energy.

Also, there have been proposed a liquid transporting method and apparatus in which the above-described electro-thermal converting member or an electro-mechanical converting member (such as a piezo element) is used as a liquid transporting mechanism and provision is made of a fluid resistance element for suppressing the movement of liquid in the direction opposite to the desired direction of movement of liquid such as the above-described back wave or the like. That is, any apparatus capable of driving liquid in one direction by some mechanism corresponds to the liquid transporting apparatus herein referred to. From the viewpoint of the liquid transporting apparatus, the ink jet recording head can be said to be one which transports liquid from an ink tank toward a discharge port, irrespective of whether an air bubble is produced by the use of an electro-thermal converting member, and discharges the ink from the discharge port at predetermined discharge pressure. For example, an ink jet recording head provided with the valve mechanism described in the above-mentioned Japanese Laid-Open Patent Application No. 63-197652 or Japanese Laid-Open Patent Application No. 63-199972 can also be regarded as one using an electro-thermal converting member as a liquid transporting mechanism, and contriving to control the flow of ink in one direction by a valve mechanism. Likewise, it is also attempted to use a piezo element to realize the flow of liquid in one direction.

However, in a case where a fluid resistance portion is provided as described in Japanese Laid-Open Patent Application No. 55-100169, as compared with a case where it is not provided, when liquid is discharged at a relatively low driving frequency, the influence of the back wave can be prevented to some extent by the action of the barrier (liquid resistance portion) provided in the liquid flow path, as previously described, but when the liquid is discharged at a frequency higher than that, the influence of the back wave from the upper portion of the barrier is unavoidable and refilling is impeded by this barrier and is delayed. Further, there arises the problem that the vibration of liquid in a nozzle cannot be controlled and repeated proper discharge cannot be effected.

Also, the technique described in Japanese Laid-Open Patent Application No. 59-199256, Japanese Laid-Open Patent Application No. 62-240558 and Japanese Laid-Open Patent Application No. 63-102945 provides, besides a heater for the discharge of liquid droplets, a heater for controlling a back wave, and contrives to control the rearward propagation of the back wave by an air bubble produced by the heater for controlling the back wave. In the case of such construction, when it is necessary to sufficiently secure the bubbling pressure of the heater bubbling for the discharge of ink liquid droplets, the bubbling pressure of the heater for controlling the back wave will be overcome by the bubbling pressure for discharge unless the heater for controlling the back wave is made sufficiently large. If the heater for controlling the back wave is made large for the sufficient control of the back wave, the length of the entire liquid flow path will become great, and this gives rise to the problem that there is rather formed an area in which refill becomes slow.

Also, when provision is made of a valve mechanism adapted to be opened by a back wave as described in Japanese Laid-Open Patent Application No. 63-197652 or Japanese Laid-Open Patent Application No. 63-199972, the air bubble for discharge naturally grows also on the upstream side of the liquid flow path, and in the process, the value mechanism disposed in the upper portion of the liquid flow path moves while corresponding to (being led by) the flow of the growing air bubble. That is, most time of the growing process of the air bubble passes until the valve mechanism 914 is opened to its position shown in FIG. 22B. Therefore, there is a case where it is impossible to suppress the back wave which is the original object and sufficiently prevent the loss of discharge energy. Particularly, when such construction is applied to a recording apparatus which discharges liquid at a high driving frequency, the frequency cannot be coped with.

SUMMARY OF THE INVENTION

It is a primary object of the present invention to provide a liquid discharging method which can substantially suppress the movement of liquid toward the upstream side of a discharge energy generating element and can improve refill efficiency.

It is a second object of the present invention to provide a liquid discharging method and a liquid discharging head which improves the refill characteristic of discharged liquid such as ink and improves discharge efficiency and discharging force, and which when applied to ink jet recording, can accomplish printing of high speed and high quality, and further provide an ink jet recording apparatus and an ink jet record utilizing such liquid discharging method or such liquid discharging head.

The main requirements of the present invention for achieving the above objects are as follows.

A liquid discharging method of discharging liquid from a discharge port by the use of a liquid discharging head having a flow path communicating with the discharge port, and a discharge energy generating element provided in the flow path for causing energy for discharging the liquid to act on the liquid, having the step of driving the discharge energy generating element to thereby discharge the liquid from the discharge port, and the step of displacing the free end of the movable member of a fluid element having an air bubble producing area disposed upstream of the discharge energy generating element in the flow path for producing an air bubble, and a movable member provided in facing relationship with the air bubble producing area and provided with a fulcrum and a free end, by producing an air bubble in the air bubble producing area.

A liquid discharging head having a flow path communicating with a discharge port, a discharge energy generating element provided in the flow path for causing energy for discharging liquid to act on the liquid, and a fluid element having an air bubble producing area disposed upstream of the discharge energy generating element in the flow path for producing an air bubble and a movable member provided in facing relationship with the air bubble producing area and provided with a fulcrum and a free end.

A liquid discharging head cartridge having the liquid discharging head and a liquid container holding therein the liquid to be supplied to the liquid discharging head.

An ink jet recording apparatus having the liquid discharging head and means for conveying a recording medium receiving the ink discharged from the liquid discharging head.

According to the liquid discharging method, etc. of the present invention, the movable member constituting the fluid element provided upstream of the liquid discharge energy generating element for discharging the liquid can be displaced at desired timing to thereby suppress the flow of the liquid to the upstream side of the discharge energy generating element and also, with the returning movement of the movable member to its steady position by the disappearing process of the air bubble in the air bubble producing area, the liquid can be rapidly supplied from the upstream side. Also, by the movable member being displaced, a back wave is prevented and yet the movable member is returned to its steady position during refill and therefore, the diameter of the flow path during refill can be made maximum without being narrowed and thus, refill can be done very easily.

Also, when the discharged liquid in a first liquid flow path and the bubbling liquid in a second liquid flow path for driving the movable member are formed of different liquids, the bubbling conditions on air bubble producing areas (heaters) corresponding to the respective liquid flow paths can be made to differ from each other and therefore, the bubbling timing in each air bubble producing area can be made different. As the result, the timing at which the movable member is displaced can be set arbitrarily and therefore, the discharged state of the liquid and the refill of the liquid can be set individually to a certain degree. As the result, even in the case of particularly the heads of the same flow path construction, the optimum driving conditions can be set depending on the difference between the discharged liquids (inks) and therefore, in the case of particularly an ink jet recording head for polychromatic recording, higher speed and higher quality of image are achieved.

Further, the bubble disappearing position on the first air bubble producing area for discharge can be controlled and therefore, the life till the breakage of the heater by cavitation can be extended and thus, there can be provided a liquid discharging head of long life.

The words "upstream" and "downstream" used herein are expressions with respect to the direction of flow of liquid travelling from a liquid supply source to the discharge port via the air bubble producing area or the direction in this construction. Also, "the downstream side" with respect to an air bubble itself represents the discharge port side portion of the air bubble which is regarded as directly acting on the discharge of liquid droplets. More specifically, it means the downstream side with respect to the direction of flow or the direction in the construction relative to the center of the air bubble, or an air bubble produced in an area downstream of the center of the area of the heat generating member.

BRIEF DESCRIPTION OF THE DRAWINGS

FIG. 20 is a side cross-sectional view showing an example of the liquid flow path structure of a liquid discharging head according to the prior art.

FIG. 21 is a side cross-sectional view showing the liquid flow path structure of a liquid discharging head according to the prior art having a fluid resistance portion.

FIG. 22A is a perspective view showing the construction of a liquid discharging head according to the prior art having a valve mechanism, and FIG. 22B is a side cross-sectional view showing the liquid flow path structure of this liquid discharging head according to the prior art.

DESCRIPTION OF THE PREFERRED EMBODIMENTS

Some embodiments of the present invention will hereinafter be described with reference to the drawings. In the following, description will be made with an ink jet recording method and an ink jet recording head taken as embodiments of the present invention, but by other liquid than ink being used as the liquid to be discharged, the present invention can be generally applied to a liquid discharging method and a liquid discharging head.

Embodiment 1

Figure 1:
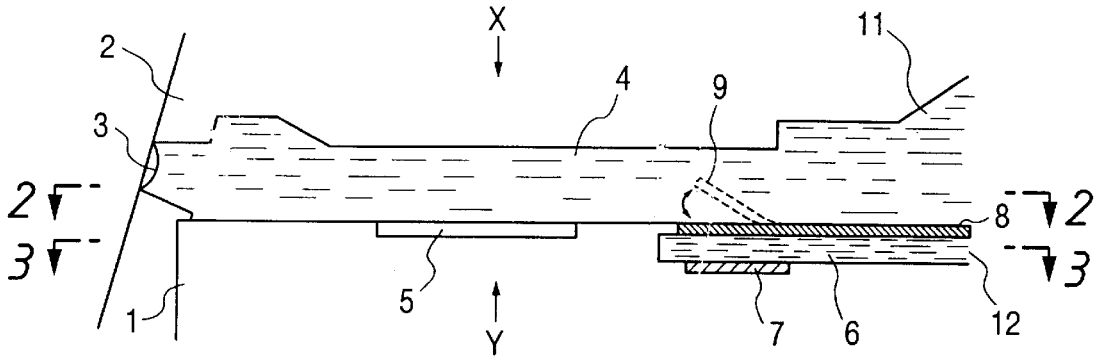
FIG. 1 is a side cross-sectional view of the liquid flow path portion of an ink jet recording head in a first embodiment of the present invention.
Figure 2:
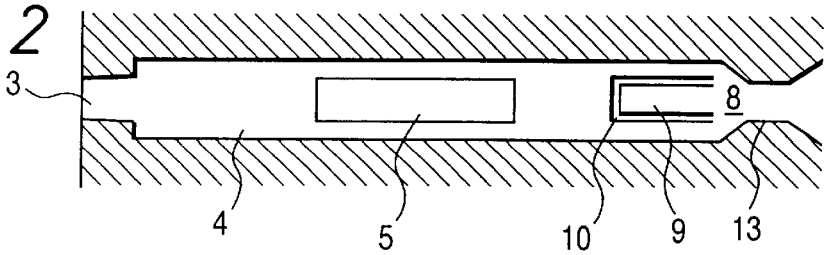
FIG. 2 is a cross-sectional view showing a cross-sectional construction along the line 2—2 of FIG. 1 as it is seen from X direction.
Figure 3:
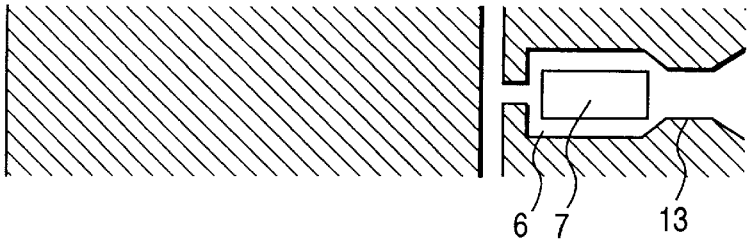
FIG. 3 is a cross-sectional view showing a cross-sectional construction along the line 3—3 of FIG. 1 as it is seen from X direction.
Figure 4:
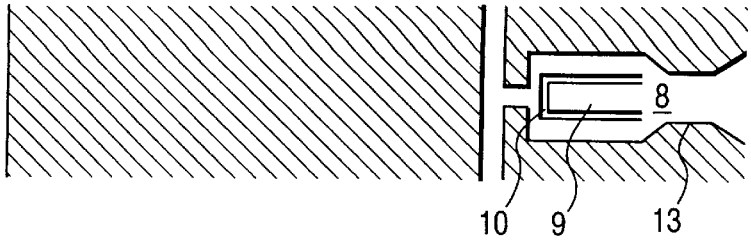
FIG. 4 is a cross-sectional view showing the cross-sectional construction along the line 3—3 of FIG. 1 as it is seen from Y direction.

FIG. 1 is a cross-sectional view of the liquid flow path of an ink jet recording head in a first embodiment of the present invention, FIG. 2 is a cross-sectional view showing a cross-sectional construction along the line 2—2 of FIG. 1 as it is seen from X direction, FIG. 3 is a cross-sectional view showing a cross-sectional construction along the line 3—3 of FIG. 1 as it is seen from X direction, and FIG. 4 is a cross-sectional view showing the cross-sectional construction along the line 3—3 of FIG. 1 as it is seen from Y direction.

A first liquid flow path (an ink liquid flow path or a discharged liquid flow path) 4 is formed in communication with a discharge port 3 for discharging ink liquid droplets, and the other end of the first liquid flow path 4 is connected to a first common liquid chamber (a common liquid chamber for ink) 11. The bottom surface of the first liquid flow path 4 except the region in which the discharge port 3 is formed is formed by a substrate 1, on the surface of which an electro-thermal converting member (heater) 5 for generating heat energy for producing as air bubble in the liquid (ink) in the first liquid flow path 4 is formed as a discharge energy generating element correspondingly to the first liquid flow path 4. The flow path portion on this heater is an air bubble producing area. The sides and upper surface of the first liquid flow path 4 and the discharge port 3 are integrally formed by a grooved top plate 2 comprising a molded article of polysulphone or the like which was laser-worked.

In the region upstream of the heater 5 on the bottom surface of the first liquid flow path 4 with respect to the flow of the ink, a second liquid flow path for bubbling liquid (a bubbling liquid flow path) 6 is disposed so as to be along the first liquid flow path 4. The space between the first liquid flow path 4 and the second liquid flow path 6 is partitioned by a separating wall 8 formed of a resilient material such as a metal constituting a fluid element, thereby distinguishing between the ink in the first liquid flow path 4 and the bubbling liquid in the second liquid flow path 6. When the same liquid is used as the liquid in the first liquid flow path and the liquid in the second liquid flow path, the partition between the two flow paths need not be complete. The second liquid flow path 6 extends to the opposite side from the direction in which the discharge port 3 is provided, and is connected to a second common liquid chamber (a common liquid chamber for bubbling liquid) 12. Also, on the bottom surface of the second liquid flow path 6, there is formed a heat generating member 7 constituting a fluid element for heating the bubbling liquid to thereby cause this liquid to bubble. This heat generating member 7, like the above-mentioned heater 5, is constituted by an electro-thermal converting member for converting electrical energy into heat energy. The second liquid flow path portion on this heat generating member is an air bubble producing area. Further, a U-shaped slit 10 is formed in the separating wall 8 in a portion located in the projection space upward to the surface of the heat generating member 7, and the separating wall 8 in that portion surrounded by the slit 10 is designed to constitute a movable member 9. Specifically, the movable member 9 is of a cantilevered beam shape having a free end on the discharge port 3 side (the downstream side with respect to the flow of ink) and having a fulcrum located on the common liquid chambers 11, 12 side. By constructing so, as will be described later, the movable member 9 is operated by the bubbling of the bubbling liquid present on the heat generating member 7 so as to open and be displaced to the first liquid flow path 4 side (the direction of arrow in FIG. 1). In its steady state, the movable member 9 is in the same plane as the other portion of the separating wall 8 than the movable member 9.

The second liquid flow path 6 is formed with reduced portions 13 forwardly and rearwardly of the heat generating member 7, and is of such chamber (bubbling chamber) structure that the pressure during bubbling is suppressed from escaping along the second liquid flow path 6 to the common liquid chamber 12 side. In the conventional ink jet recording head, when the flow path for bubbling and the flow path for discharging the liquid are made common and a reduced portion is provided so that the pressure produced on the liquid chamber side from the heat generating member may not escape to the common liquid chamber side, it has been necessary to adopt a construction in which the cross-sectional area of the flow path in the reduced portion is not very small with the refill of the liquid to be discharged sufficiently taken into account. However, in the case of the ink jet recording head according to the present embodiment, almost all of the liquid to be discharged from the discharge port 3 is the ink (discharged liquid) in the first liquid flow path 4 and the bubbling liquid in the second liquid flow path 6 wherein the heat generating member 7 is provided is not much consumed and therefore, the quantity of bubbling liquid filling the discharge pressure producing portion of the second liquid flow path 6 may be small. Accordingly, the interval in the above-mentioned reduced portions 13 can be made as small as several $\mu$m to 10 and several $\mu$m, and the pressure during bubbling produced in the second liquid flow path 6 can be concentratedly directed toward the movable member 9 side without much escaping to the surroundings. This pressure is utilized as discharge pressure through the movable member 9 and therefore, higher discharging efficiency and discharging force can be achieved. However, the shape of the second liquid flow path 6 is not limited to the above-described one, but may be any shape which permits the pressure resulting from the production of an air bubble to be effectively transmitted to the movable member 9 side.

In the above-described construction, the heater 5 as the discharge energy generating element in the first liquid flow path 4 constitutes a first air bubble producing area, and the heat generating member 7 in the second liquid flow path 6 constitutes a second air bubble producing area.

Actually, an ink jet recording head is provided with a plurality of discharge ports, but in the present embodiment, a first liquid flow path 4, a heater 5, a second liquid flow path 6, a heat generating member 7 and a movable member 9 are provided for each discharge port 3. A grooved top plate 2 formed with a plurality of discharge ports 3 and first liquid flow paths 4 communicating with the respective discharge ports 3, a substrate 1 provided with a number of heaters 5 and heat generating members 7 corresponding to the number of the discharge ports 3, and a separating wall 8 formed with a number of slits 10 (i.e., movable members 9) corresponding to the number of discharge ports 3 are prepared, and the grooved top plate 2 and the substrate 1 are joined together in such a manner as to sandwich the separating wall 8 between the common liquid chambers 11 and 12 to thereby complete an ink jet recording head. The separating wall 8 in the present embodiment is also formed with a partition wall for partitioning the adjacent second liquid flow path 6. The partition wall between the second liquid flow paths 6 and the separating wall 8 separating the first liquid flow path 4 and the second liquid flow path 6 from each other may be individually formed and these may be joined together to thereby form the second liquid flow path 6.

Description will now be made of a material for forming the separating wall 8, i.e., the movable member 9. The material is not limited to nickel if it performs the function as the movable member. That is, the material forming the separating wall 8 may be any one which is resistant to the bubbling liquid and ink (discharged liquid) and has elasticity for operating well as the movable member 9 and which permits a minute slit to be formed therein. As such materials, mention may preferably be made of metals of high durability such as silver, nickel, gold, iron, titanium, aluminum, platinum, tantalum, stainless steel and phosphor bronze, and alloys thereof, or resin having nitrile group such as acrylonitrile, butadiene and styrene, resin having amide group such as polyamide, resin having carboxyl such as polycarbonate, resin having aldehyde group such as polyacetal, resin having sulphone group such as polysulphone, resin such as liquid crystal polymer and compounds thereof, metals of high ink-resisting property such as gold, tungsten, tantalum, nickel, stainless steel and titanium, and alloys thereof, and regarding the ink-resisting property, resin coated with one of these metals or resin having amide group such as polyamide, resin having aldehyde group such as polyacetal, resin having ketone group such as polyether-ether-ketone, resin having imide group such as polyimide, resin having hydroxyl group such as phenol resin, resin having ethyl group such as polyethylene, resin having alkyl group such as polypropylene, resin having epoxy group such as epoxy resin, resin having amino group such as melamine resin, resin having methylol group such as xylene resin and compounds thereof, and ceramics such as silicon dioxide and compounds thereof. Also, the thickness of the separating wall 8 and the shape of the movable member 9 are not restricted to the present embodiment if they are displaceable enough to perform their functions by the combination thereof with the size of the heat generating member 7, but yet the thickness may desirably be about 0.5 $\mu$m–10 $\mu$m.

In the present embodiment, the width of the slit 10 for forming the movable member 9 is 2 $\mu$m, but when the bubbling liquid and the discharged liquid are different liquids and it is desired to prevent the mixing of the two liquids, the width of the slit can be such a degree of interval that forms stable meniscus between the two liquids, and the communication between the two liquids can be suppressed.

In the present embodiment, as the heater 5 and the heat generating member 7, use is made of ones having as a heat generating portion a heat generating resistance member of hafnium boride, tantalum nitride or the like generating heat in response to an electrical signal, whereas this is not restrictive, but they may be any one which will produce sufficient air bubbles in the bubbling liquid and ink. For example, as the heater 5 or the heat generating member 7, use may be made of one having as the heat generating portion an opto-thermal converting member which will generate heat by receiving the light of a laser or the like. The heater 5 or the heat generating member 7 may include not only the heat generating portion but also protective film for protecting the heat generating portion from liquid. Also, the discharge energy generating element 5 can be any one which can apply sufficient energy for the liquid to be discharged, and need not always be a heater, but may be, for example, a piezoelectric element or the like.

The grooved top plate 2 is formed with a discharge port 3 by laser-working a molded article of polysulphone. However, the material of the grooved top plate may be a material which can be laser-worked, and is not limited to polysulphone. Also, depending on the ink used, polysulphone may be subjected to plating or the like.

As the liquid to be supplied to the second liquid flow path 6 (i.e., the bubbling liquid), use can be made of one of various liquids which are not deteriorated by heat and are difficult for deposits to be created on the heat generating member by heating and can effect a reversible state change of gasification and cordasation by heat. As typical liquid, mention may be made of a mixture of ethanol and water, and further, methanol, ethanol, n-propanol, isopropanol, n-hexane, n-heptane, n-octane, toluene, xylene, methylene dichloride, trichlene, Freon TF, Freon BF, ethyether, dioxane, cyclohexane, methyl acetate, ethyl acetate, acetone, methylethylketone, water, etc. and mixtured thereof.

Also, as a recording medium to which liquid such as ink is to be imparted, mention may be made of various kinds of paper, OHP sheet, a plastic material used for a compact disc, a decoration plate or the like, a metallic material such as aluminum or copper, a leather material such as oxhide, cowhide pigskin or artificial leather, wood such as a tree or plywood, a bamboo material, a ceramic material such as tile, a three-dimensional structure such as sponge, etc.

The operation of this ink jet recording head will now be described with reference to FIGS. 5A to 5E. FIGS. 5A to 5E are views for illustrating the operation in succession. It is to be understood here that ink of the same water origin is used as the liquid supplied to the first liquid flow path 4 and the liquid supplied to the second liquid flow path 6.

Figure 5A:
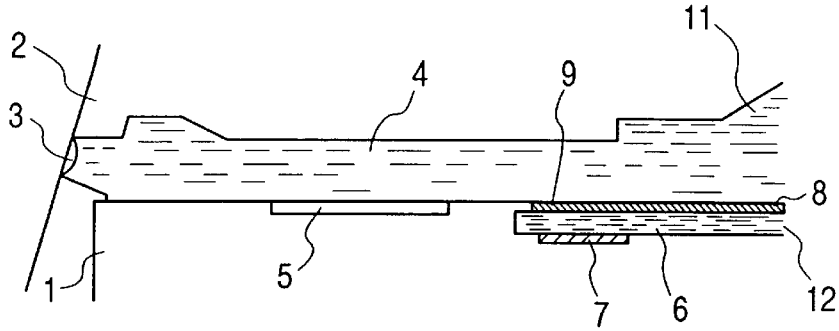
FIGS. 5A, 5B, 5C, 5D and 5E successively show the liquid droplet discharging process in the ink jet recording head of FIG. 1.
Figure 5B:
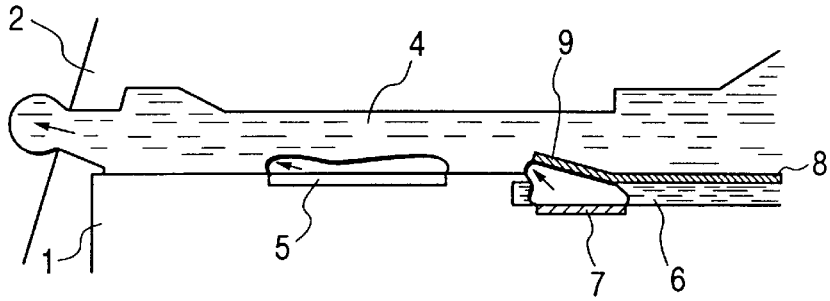
Figure 5C:
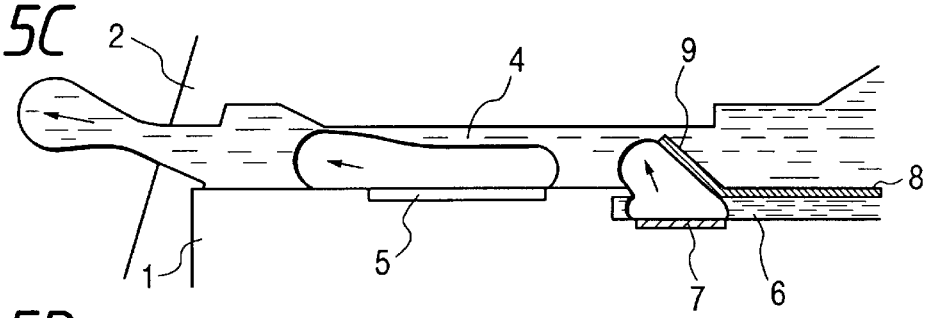
Figure 5D:
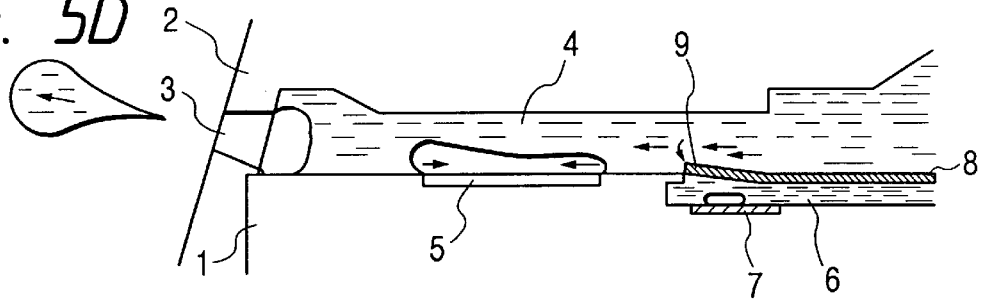

FIG. 5A shows a state in which both of the heater 5 and the heat generating member 7 are non-conductive, and at this time, there is not the displacement of the movable member 9 formed on the separating wall 8 and there is neither the bubbling by the heater 5. The liquid flow paths 4 and 6 are both filled with ink of the water origin. When in this state, a drive signal is given to the heater 5 and the heat generating member 7, the heater 5 and the heat generating member 7 generate heat, and as shown in FIG. 5B, the heat generated by the heater 5 acts, whereby an air bubble by a film boiling phenomenon is produced in the ink in the first liquid flow path 4, and likewise, the heat generated by the heat generating member 7 acts, whereby an air bubble by a film boiling phenomenon is produced in the ink in the second liquid flow path 6. The pressure based on the production of the air bubble in the second liquid flow path 6 and this air bubble preferentially act on the movable member 9 to thereby displace the movable member 9 toward the first liquid flow path 4 side. The aforementioned pressure and air bubble go into the first liquid flow path 4 from a gap formed on the free end side toward the discharge port 3 and thus, the bubbling pressure of this air bubble acts on the liquid in the first liquid flow path 4 toward the discharge port 3 side. On the other hand, the air bubble formed on the heater 5 also grows and coupled with the pressure of the air bubble from the second liquid flow path 6 side, the liquid protrudes from the discharge port 3.

Further, after the production of the air bubbles, the respective air bubbles grow and particularly, the displacement of the movable member 9 reaches a maximum amount and the air bubble attributable to the heat generating member 7 comes to the first liquid flow path 4 at the position whereat the movable member 9 is present. As a result, the back wave of the bubbling attributable to the heater 5 is prevented from being propagated to the common liquid chamber 11 side, and rather receives the bubbling force from the air bubble by the heat generating member 7 and as a whole, the bubbling force for discharge is strengthened and an ink droplet greatly protrudes from the discharge port 3, whereafter it is torn off in the process of disappearance of the bubble on the heater 5 and flies toward the recording medium.

Figure 5E:
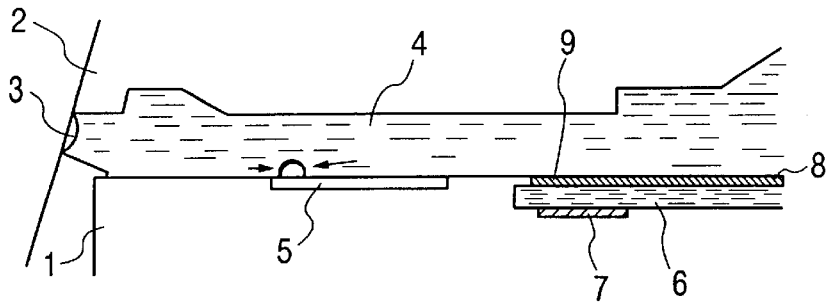

Each air bubble enters its process of disappearance. At this time, the movable member 9 receives the negative pressure by the disappearance of the bubble in the second liquid flow path 6, in addition to its own resilient force, and rapidly returns to its steady state, and with the movement when the movable member 9 returns to its steady state, the ink rapidly flows from the common liquid chamber 11 into the first liquid flow path 4 by the negative pressure of the disappearance of the bubble on the heater 5. With the disappearance of the bubble on the heater 5, the meniscus surface of the ink retreats from the discharge port 3 side toward the upstream side, but in the case of the present embodiment, the influence of the movement when the movable member 9 returns to its steady state is great and therefore, the refill of the first liquid flow path 4 with the ink is rapidly achieved and as shown in FIG. 5E, the ink forms a meniscus at the position of the discharge port 3 and the movable member returns to its steady state.

As described above, in the present embodiment, the second liquid flow path 6 in which the heat generating member 7 is provided adjacent to the first liquid flow path 4 and the movable member 9 is provided between the two liquid flow paths 4 and 6, whereby as compared with the liquid discharging head of the conventional construction, it becomes possible to discharge droplets of ink or the like at high discharge efficiency and high discharge pressure. It is considered to owe the following phenomena and the interaction between these phenomena that such high discharge energy and high discharge pressure can be realized.

First, of the discharge pressure produced in the second liquid flow path 6 by the aforementioned displacement of the movable member 9, almost all of the discharge pressure propagated to the movable member 9 side is liberated toward the discharge port 3 of the first liquid flow path 4. That is, the direction of propagation of the discharge pressure produced in the second liquid flow path 6 is changed toward the discharge port 3 by the movable member 9. Simultaneously therewith, in the first liquid flow path 4, the air bubble grows on the heater 5, and thus, on the discharge port 3 side, the bubbling pressure of the two air bubbles is summed and discharge pressure is produced. At this time, the back wave by the air bubble on the heater 5 is reflected by the air bubble by the movable member 9 and the heat generating member 7 and rather goes toward the discharge port 3 and thus, the discharge pressure is further heightened.

Next, each air bubble contracts and the movable member 9 returns to the position in its steady state and also, in the first liquid flow path 4, a quantity of liquid corresponding to the quantity of discharged liquid is supplied from the upstream side. This supply of the discharged liquid is in the direction in which the movable member 9 is closed and therefore, the refill of the discharged liquid is not hampered by the movable member 9. Thus in the construction of the present embodiment, the liquid on the upstream side of the first liquid flow path 4 is hardly affected by the back wave and therefore, the one-direction property of the flow of the liquid from the upstream side to the downstream side is strong and refill is done well. Also, the bubbling liquid in the second liquid flow path 6 is little used as described above and therefore, the refill ends with a slight quantity.

As shown in FIGS. 5A to 5E, a part of the air bubble produced in the air bubble producing area (the heat generating member 7) of the second liquid flow path 6 with the displacement of the movable member 9 toward the first liquid flow path 4 extends toward the first liquid flow path 4 side, and by adopting such height of the second liquid flow path 6 that the air bubble extends like this, it is possible to further improve the discharging force as compared with a case where the air bubble does not extend. In order that the air bubble may extend toward the first liquid flow path 4 like this, it is desirable to make the height of the second liquid flow path smaller than the height of the largest air bubble, and this height may desirably be several $\mu$m to 30 $\mu$m. In the present embodiment, this height is 15 $\mu$m.

Embodiment 2

The previous embodiment has been described with respect to a case where the drive timing (bubbling timing) of the discharge energy generating element and the drive timing (bubbling timing) of the fluid element are substantially the same, but in the present embodiment, there is shown an example of the case where these timings are made different from each other.

FIGS. 6A to 6E show an example of the drive timing in the present embodiment, and illustrate the operation of the ink jet when the drive timing of the fluid element is earlier than the drive timing of the discharge energy generating element.

Figure 6A:
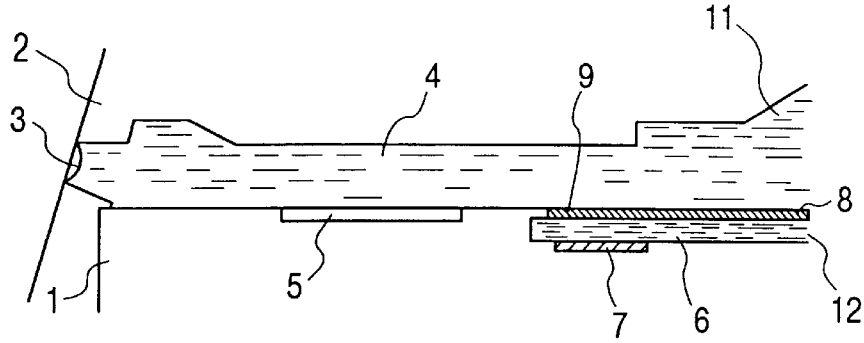
FIGS. 6A, 6B, 6C, 6D and 6E show other examples of drive timing.
Figure 6B:
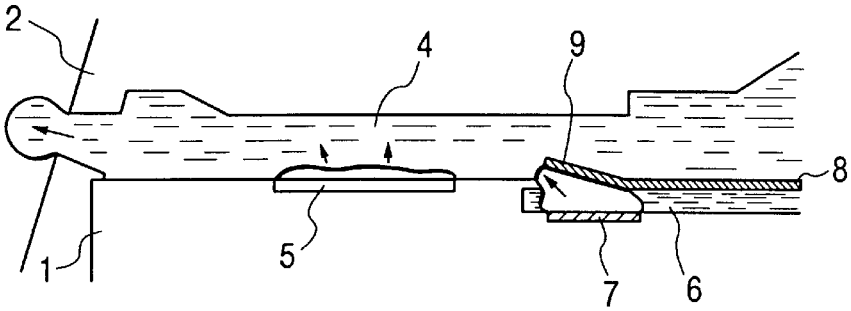
Figure 6C:
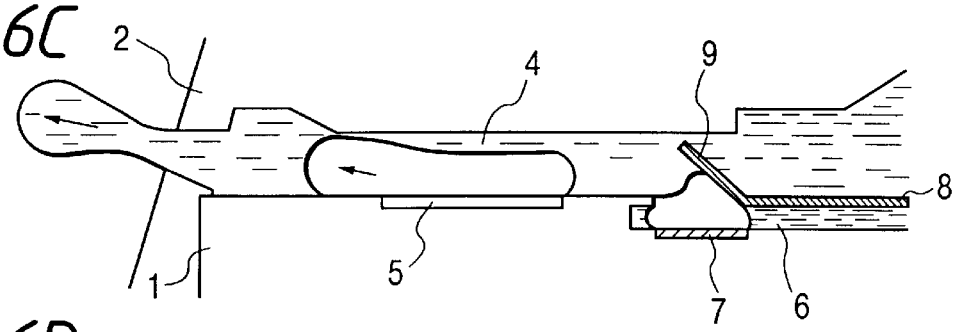
Figure 6D:
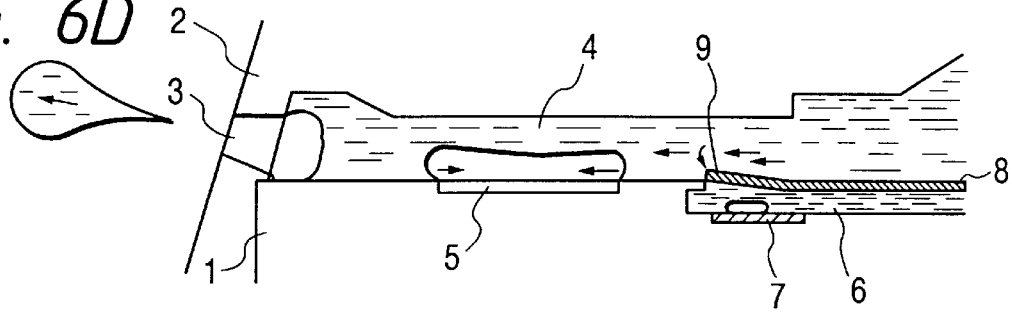
Figure 6E:
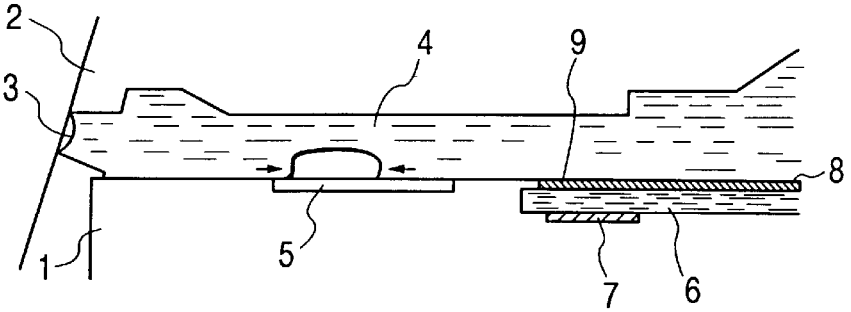

As in the previous embodiment, FIG. 6A shows the state (the non-driven state) before both of the discharge energy generating element and the fluid element are driven.

First, the heat generating member 7 constituting the fluid element is electrically energized and generates heat. By this generated heat, an air bubble is produced in the ink and along therewith, the movable member 9 constituting the fluid element is displaced toward the flow path 4. Next, the heat generating member 5 which is a discharge energy generating element is electrically energized and an air bubble is produced 6B. By the pressure based on the production of the air bubble, the ink is discharged from the discharge port 6C. At this time, the movable member is already in its displaced state and therefore, the movement of the ink toward the upstream side can be prevented more reliably and also, the movement of the ink toward the discharge port side has taken place in advance by the fluid element and therefore, the discharging force and the discharging speed can be further improved.

The air bubble by the heat generating member 7 disappears, whereby the movable member is returned to its initial state. Also, as the air bubble produced by the heat generating member 5 disappears, the ink is supplied (refilled) from the upstream liquid chamber 11, but since the direction of this refill and the direction in which the movable member is returned to its initial state are the same direction, the movable member does not hamper the refill.

In the present embodiment, the bubbling timing of the fluid element is earlier than the bubbling timing of the discharge energy generating element, but driving at the converse timing may be done in conformity with the purpose. As described above, by the bubbling timing of the discharge energy generating element and the bubbling timing of the fluid element being suitably adjusted, the discharge characteristic, the suppression characteristic of the movement of the ink toward the upstream side, the refill characteristic, etc. can be adjusted. Therefore, when the head of the present invention is mounted on apparatuses differing in the driving frequency, a refill characteristic, etc. matching the driving frequency of each apparatus can be obtained by adjusting the two drive timings.

Embodiment 3

Figure 7:
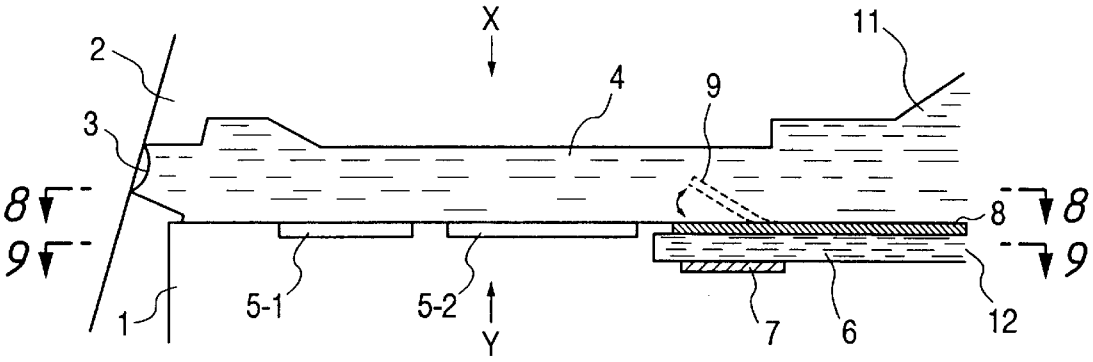
FIG. 7 is a side cross-sectional view of the liquid flow path portion of an ink jet recording head in a second embodiment of the present invention.
Figure 8:
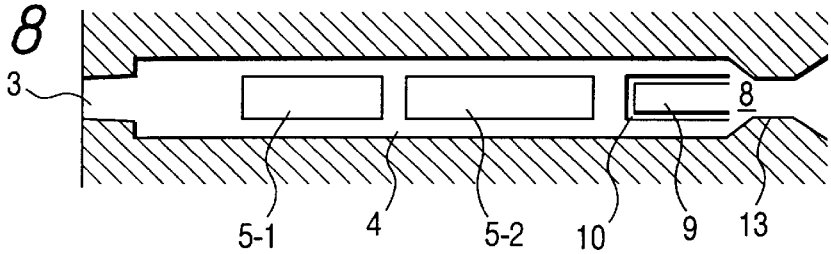
FIG. 8 is a cross-sectional view showing a cross-sectional construction along the line 8—8 of FIG. 7 as it is seen from X direction.
Figure 9:
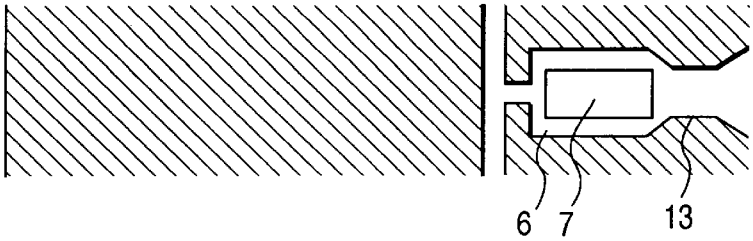
FIG. 9 is a cross-sectional view showing a cross-sectional construction along the line 9—9 of FIG. 7 as it is seen from X direction.
Figure 10:
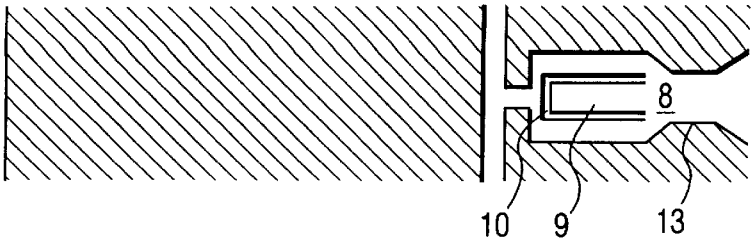
FIG. 10 is a cross-sectional view- showing the cross-sectional construction along the line 9—9 of FIG. 7 as it is seen from Y direction.
Figure 11A:
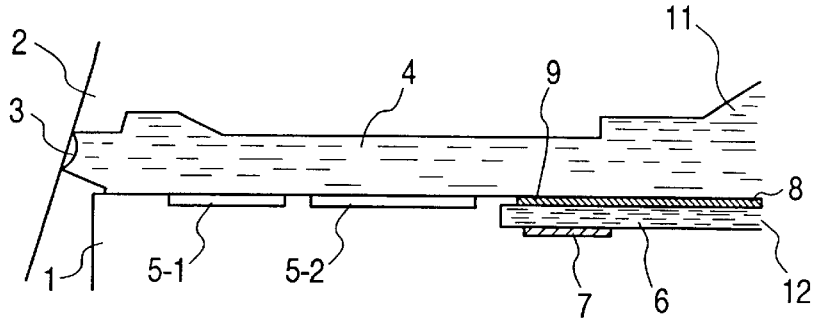
FIGS. 11A, 11B, 11C, 11D and 11E successively show an example of the liquid droplet discharging process in the ink jet recording head of FIG. 7.
Figure 11B:
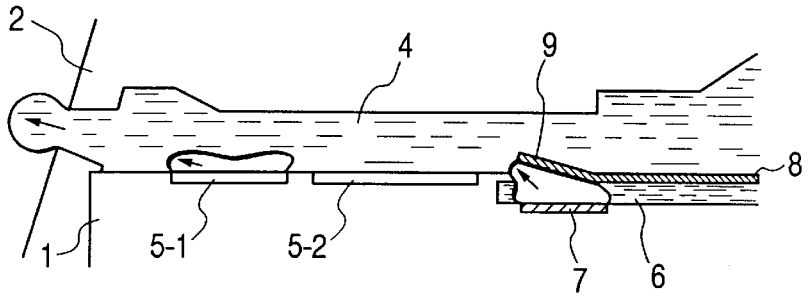
Figure 11C:
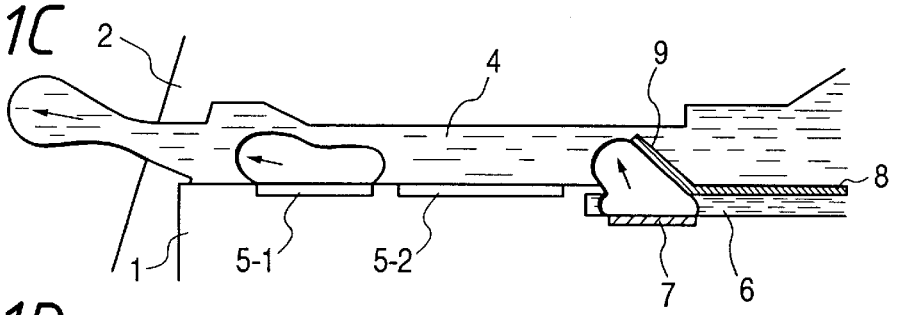
Figure 11D:
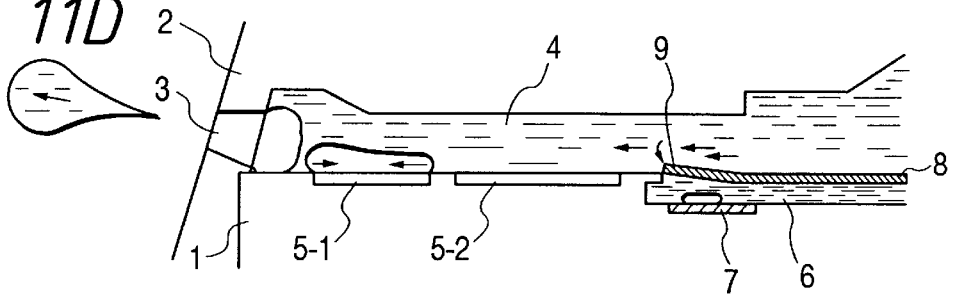
Figure 11E:
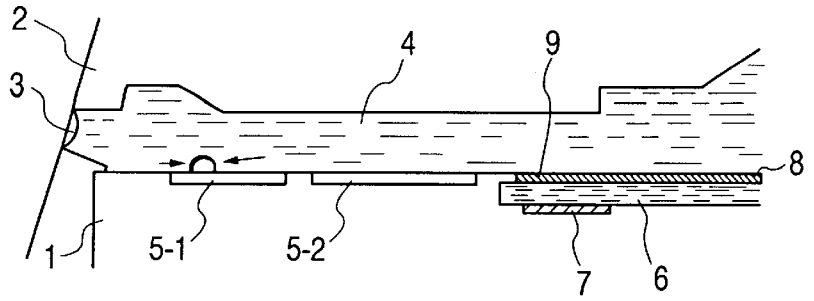
Figure 12A:
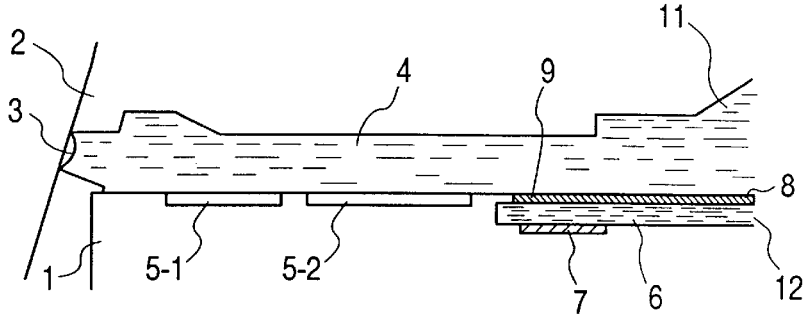
FIGS. 12A, 12B, 12C, 12D and 12E successively show another example of the liquid droplet discharging process in the ink jet recording head of FIG. 7.
Figure 12B:
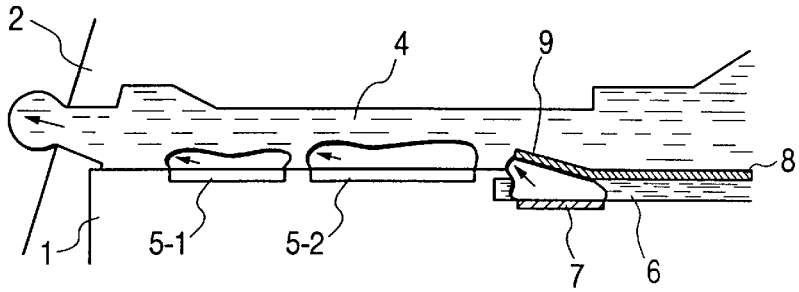
Figure 12C:
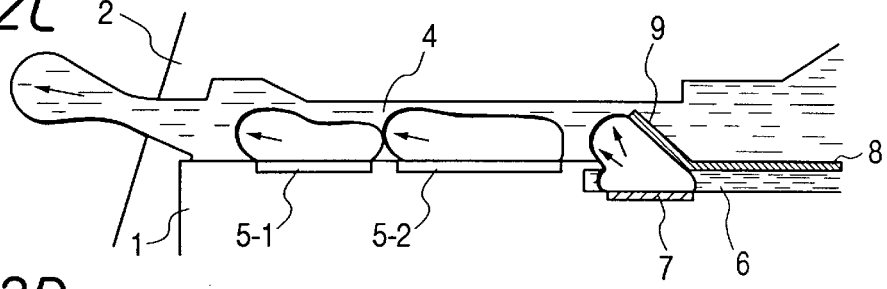
Figure 12D:
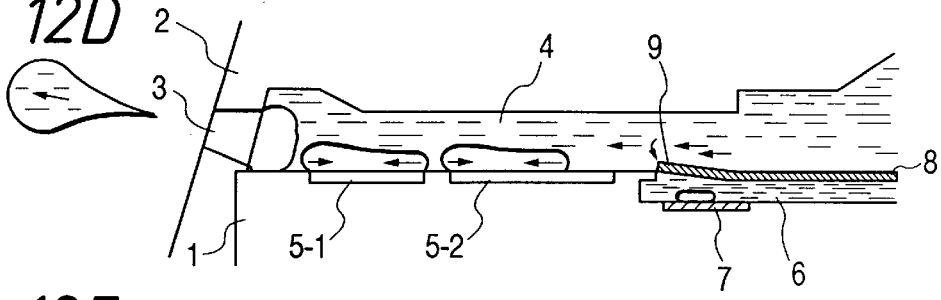
Figure 12E:
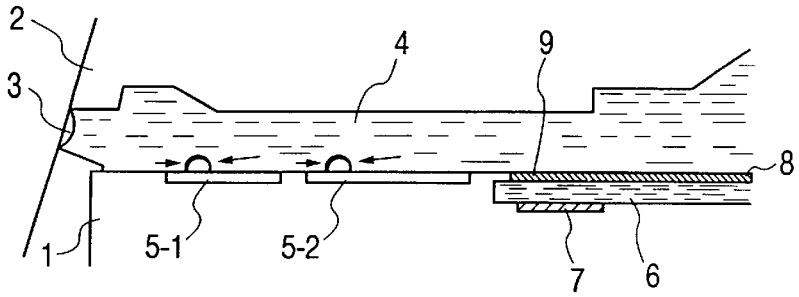

FIG. 7 is a cross-sectional view of the liquid flow path of an ink jet recording head in a third embodiment of the present invention, FIG. 8 is a cross-sectional view showing a cross-sectional construction along the line 8—8 of FIG. 7 as it is seen from X direction, FIG. 9 is a cross-sectional view showing a cross-sectional construction along the line 9—9 of FIG. 7 as it is seen from X direction, and FIG. 10 is a cross-sectional view showing the cross-sectional construction along the line 9—9 of FIG. 7 as it is seen from Y direction.

The difference of this ink jet recording head from the ink jet recording head of the first embodiment is that the heater in the first liquid flow path is divided into two in the direction of flow of the ink. As compared with the area of the downstream heater 5-1, the area of the upstream heater 5-2 is large, and design is made such that according to the upstream hearer 5-2, a larger air bubble can be produced.

FIGS. 11A to 11E successively show the process of driving the downstream heater 5-1 in the first liquid flow path 4 and the heat generating member 7 in the second liquid flow path 6 to thereby discharge ink droplets from the discharge port 3, and FIGS. 12A to 12E successively show the process of driving the both heaters 5-1 and 5-2 in the first liquid flow path 4 and the heat generating member 7 in the second liquid flow path 6 to thereby discharge ink droplets from the discharge port 3.

When only the downstream heater 5-1 in the first liquid flow path 4 is driven, only a relatively small air bubble is produced in the first liquid flow path 4 and therefore, the quantity of ink discharged from the discharge port 3 becomes small. In contrast, when the both heaters 5-1 and 5-2 in the first liquid flow path 4 are driven, the both air bubbles produced by these heaters 5-1 and 5-2 are concerned in the discharge of the ink and a greater quantity of discharged ink is obtained. Although not shown here, when only the upstream heater 5-2 in the first liquid flow path 4 is driven, there is obtained a quantity of discharged ink greater than when only the downstream heater 5-1 is driven and smaller than when the both heaters 5-1 and 5-2 are driven. After all, three stages of modulation of the quantity of discharged ink can be effected by selecting one of the heaters 5-1 and 5-2 which is to be driven, and it becomes possible to effect multivalue recording by the use of the same nozzle.

Likewise, if n heaters of different sizes are provided in the first liquid flow path 4, multivalue recording in $2^n-1$ stages of quantity of discharged ink will become possible.

Embodiment 4

Figure 13:
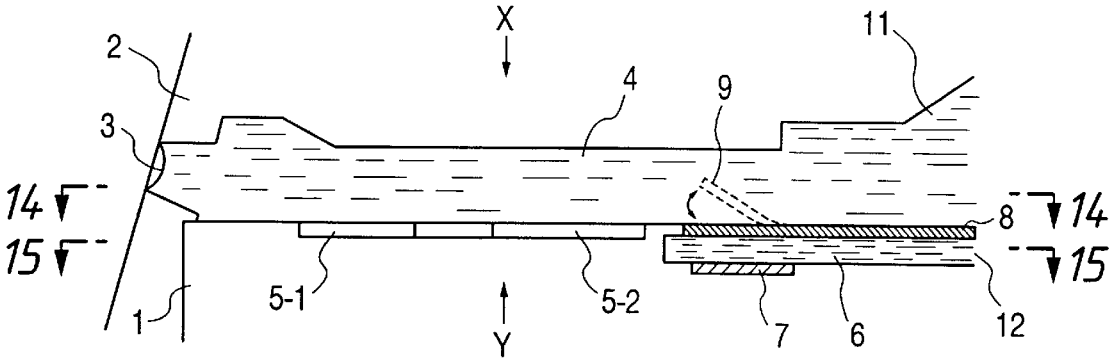
FIG. 13 is a side cross-sectional view of the liquid flow path portion of an ink jet recording head in a third embodiment of the present invention.
Figure 14:
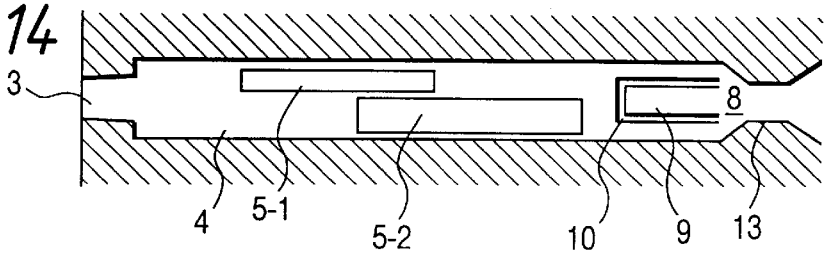
FIG. 14 is a cross-sectional view showing a cross-sectional construction along the line 14—14 of FIG. 13 as it is seen from X direction.
Figure 15:
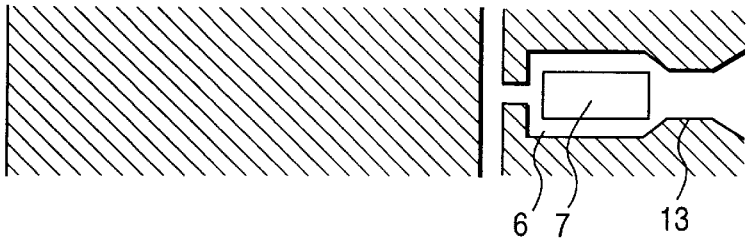
FIG. 15 is a cross-sectional view showing a cross-sectional construction along the line 15—15 of FIG. 13 as it is seen from X direction.
Figure 16:
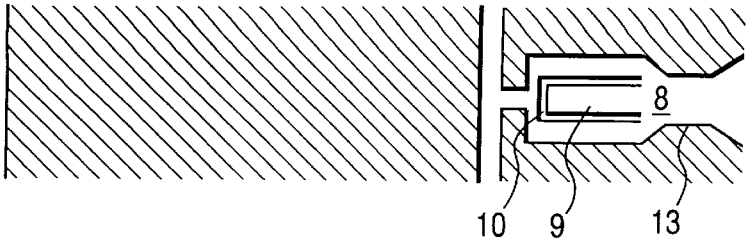
FIG. 16 is a cross-sectional view showing the cross-sectional construction along the line 15—15 of FIG. 13 as it is seen from Y direction.

FIG. 13 is a cross-sectional view of the liquid flow path of an ink jet recording head in a fourth embodiment of the present invention, FIG. 14 is a cross-sectional view showing a cross-sectional construction along the line 14—14 of FIG. 13 as it is seen from X direction, FIG. 15 is a cross-sectional view showing a cross-sectional construction along the line 15—15 of FIG. 13 as it is seen from X direction, and FIG. 16 is a cross-sectional view showing the cross-sectional construction along the line 15—15 of FIG. 13 as it is seen from Y direction.

In the above-described third embodiment, the two heaters 5-1 and 5-2 are disposed in series along the direction of flow of the ink in the first liquid flow path 4, while in this fourth embodiment, the two heaters 5-1 and 5-2 are disposed in parallel. Again in this fourth embodiment, the areas of the heaters 5-1 and 5-2 differ from each other, whereby three stages of modulation of the quantity of discharged ink can be effected and multivalue recording becomes possible by the use of the same nozzle.

Liquid Discharging Head

Description will hereinafter be made of a liquid discharging head having the above-described flow path structure and provided with a plurality of discharge ports.

Figure 17:
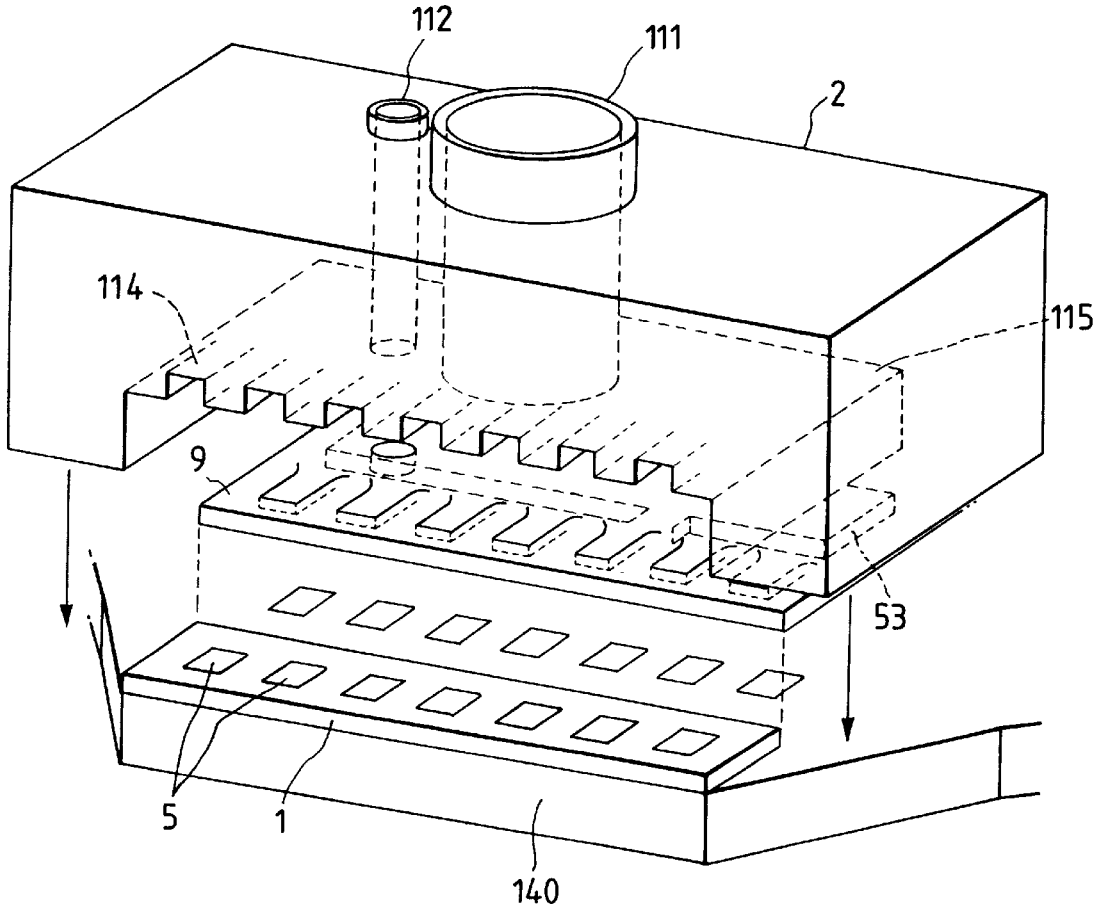
FIG. 17 is a schematic exploded perspective view of an example of the liquid discharging head of the present invention.

FIG. 17 is a schematic exploded perspective view for illustrating the main construction of an example of the liquid discharging head based on the present invention. A substrate 1 is disposed on a support member 140 formed of a metal such as aluminum. On the substrate 1, there are provided a plurality of heat generating members 7 adapted to generate heat for causing the liquid in the second liquid flow path to produce an air bubble by film boiling, and heaters 5 adapted to generate heat for causing the liquid in the first liquid flow path to produce an air bubble by film boiling. These heaters 5 and heat generating members 7 are constructed as electro-thermal converting members, and on the substrate 1, besides the heaters 5 and the heat generating members 7 and wiring electrodes for supplying electrical signals to the heaters 5 and the heat generating members 7, there are integrally made functional elements such as transistors, diodes, latches and shift registers for selectively driving the heaters 5 and the heat generating members 7. Also, protective layers for protecting the electro-thermal converting members are provided on the heaters 5 and the heat generating members 7.

On the substrate 1, there are positioned and fixed a grooved member having a plurality of grooves 52 (only one bubbling liquid flow path being shown) constituting the second liquid flow paths (bubbling liquid flow paths), and a recess constituting a second common liquid chamber (common bubbling liquid chamber) 12 communicating with the plurality of second liquid flow paths for supplying liquid to the respective liquid flow paths, and the separating wall 8 provided with the aforedescribed movable member 9. In FIG. 17, there is shown the separating wall 8 in which the partition walls between the second liquid flow paths are made integral with each other.

The grooved top plate 2 has grooves 114 joined to the separating wall 8 to thereby constitute first liquid flow path (discharged liquid flow paths), a recess for constituting a first common liquid chamber 11 communicating with the plurality of first liquid flow paths for supplying discharged liquid to the respective first liquid flow paths, a first supply port (discharged liquid supply port) 111 for supplying the discharged liquid to the first common liquid chamber 11, and a second supply port (bubbling liquid supply port) 112 for supplying the bubbling liquid to the second common liquid chamber 12. The second supply port 112 is disposed outside the first common liquid chamber 11 and is connected to a communication path extending through the separating wall 8 and communicating with the second common liquid chamber 12, and can supply the bubbling liquid to the second common liquid chamber 12 by this communication path without mixing it with the discharged liquid.

The arrangement relationship among the substrate 1, the separating wall 8 and the grooved top plate 2 is such that the movable member 9 is disposed correspondingly to the heat generating members 7 on the substrate 1.

Liquid Discharging Head Cartridge

Figure 18:
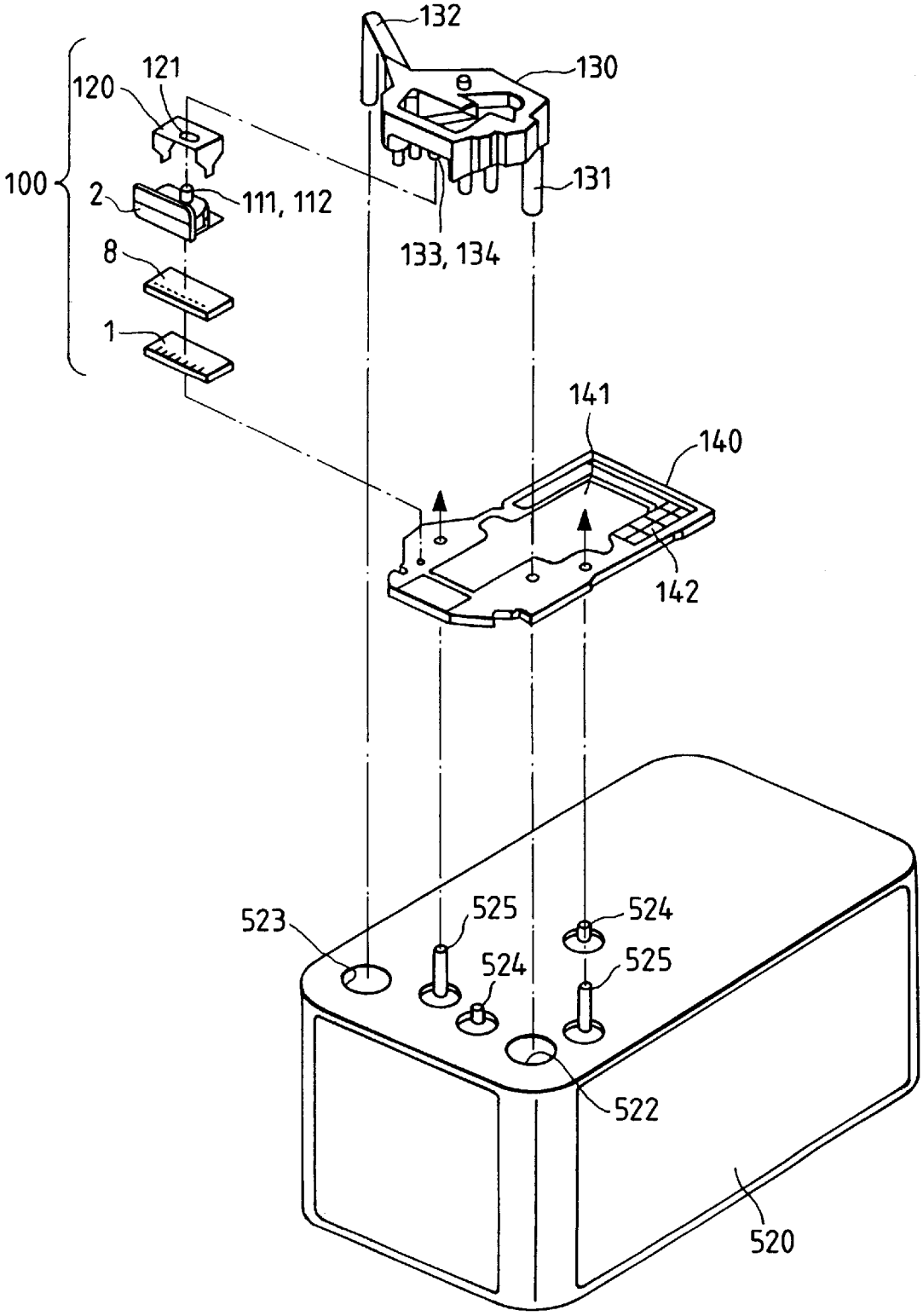
FIG. 18 is a schematic exploded perspective view of an example of the liquid discharging head cartridge of the present invention.

Brief description will now be made of a liquid discharging head cartridge carrying thereon the liquid discharging head according to the above-described embodiment. FIG. 18 is a schematic exploded perspective view of the liquid discharging head cartridge including the aforedescribed liquid discharging head, and this liquid discharging head cartridge is comprised chiefly of a liquid discharging head portion 100 and a liquid container 520.

The liquid discharging head portion 100 comprises a substrate 1, a separating wall 8, a grooved top plate 2, a keep spring 120, a liquid supplying member 130, a support member 140, etc.

On the substrate 1, as previously described, a plurality of heaters 5 and a plurality of heat generating members 7 are provided in rows, and a plurality of functional elements for selectively driving these heaters 5 and heat generating members 7. A second liquid flow path is formed between the substrate 1 and the separating wall 8 having the movable member 9 and the bubbling liquid flows therethrough. By the separating wall 8 and the grooved top plate 2 being joined together, there is formed a first liquid flow path through which the discharged liquid flows.

The keep spring 120 is a member for causing its biasing force toward the substrate 1 to act on the grooved top plate 2, and by this biasing force, the substrate 1, the separating wall 8, the grooved top plate 2 and the support member 140 which will be described later are well made integral with one another.

The support member 140 is for supporting the substrate 1, etc., and on this support member 140, there are further disposed a circuit substrate 141 connected to the substrate 1 for supplying an electrical signal thereto, and a compact pad 142 connected to the apparatus side to thereby effect the exchange of electrical signals with the apparatus side.

The liquid container 520 contains therein discharged liquid such as ink supplied to the liquid discharging head and bubbling liquid for producing air bubbles. Outside the liquid container 520, there is provided a fixing shaft 525 to which is fixed a positioning portion 524 for making the connection between the liquid discharging head and the liquid container 520. The discharged liquid is supplied from the discharged liquid supply path 522 of the liquid container 520 to the discharged liquid supply path 131 of the liquid supplying member 130, and is supplied to the first common liquid chamber 11 through the discharged liquid supply ports 133, 121 and 111 of the respective members. The bubbling liquid is likewise supplied from the supply path 523 of the liquid container 520 to the bubbling liquid supply path 132 of the liquid supplying member 130, and is supplied to the second common liquid chamber 12 through the bubbling liquid supply ports 134, 121 and 112 of the respective members.

In the above-described liquid discharging head cartridge, description has been made with respect to the form of supply and the liquid container in which supply can be effected even when the bubbling liquid supplied to the second liquid flow path and the discharged liquid (such as ink) supplied to the first liquid flow path are different liquids, but when the discharged liquid and the bubbling liquid are the same, the supply route and container for the bubbling liquid and discharged liquid need not be divided.

This liquid container may be used by being refilled with the liquid after the consumption of each liquid. For this purpose, it is desirable to form a liquid inlet port in the liquid container. Also, the liquid discharging head portion and the liquid container may be integral with each other or separable from each other.

Ink Jet Recording System

Description will now be made of an example of an ink jet recording system using the liquid discharging head of the present invention as a recording head, and effecting recording on a recording medium.

Figure 19:
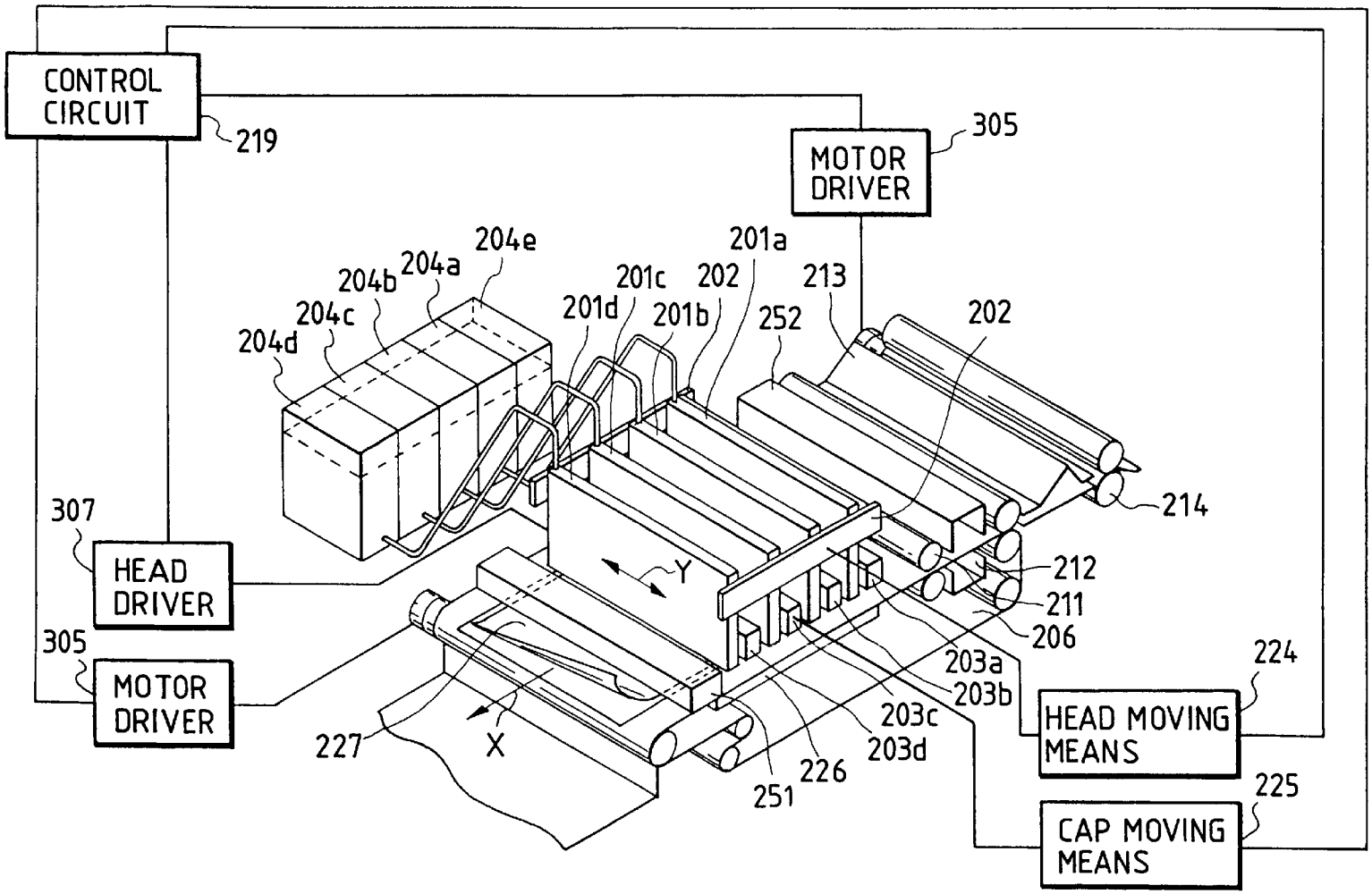
FIG. 19 shows an example of the construction of an ink jet recording system.

FIG. 19 is a model view for illustrating the construction of an ink jet recording system using the aforedescribed liquid discharging head 201 based on the present invention. The liquid discharging head in the present embodiment is a full line type head having a plurality of discharge ports disposed at intervals of 360 dpi in the lengthwise direction corresponding to the recording width of a recording medium 227, and comprises four heads corresponding to four colors, i.e., yellow (Y), magenta (M), cyan (C) and black (Bk), and fixedly supported in parallelism to one another with predetermined intervals in X direction by a holder 202.

A signal is supplied from head drivers 220 constituting drive signal supplying means to these heads, and each head is driven on the basis of this signal.

The respective heads are supplied with inks of four colors Y, M, C and Bk as discharged liquid from ink containers 204*a*–204*d*. A bubbling liquid container 204*e* is provided and the bubbling liquid is stored therein and design is made such that the bubbling liquid is supplied from this bubbling liquid container 204*e* to each head.

Head caps 203*a*–203*d* having ink absorbing members such as sponge disposed therein are provided below the respective heads, and during non-recording, the discharge ports of the respective heads can be covered with these head caps to thereby accomplish the maintenance of the heads.

A conveying belt 206 constitutes conveying means for conveying various kinds of recording mediums. The conveying belt 206 is drawn around a predetermined route by various kinds of rollers, and is driven by a driving roller connected to a motor driver 305.

In the ink jet recording system of the present embodiment, a pre-treating apparatus 251 and a post-treating apparatus 252 for effecting various kinds of treatment on the recording medium before and after recording is effected are provided upstream and downstream, respectively, of a recording medium conveying route.

The pre-treatment and the post-treatment differ in their substances in conformity with the kind of the recording medium on which recording is effected and the kind of the ink, and for example, to a recording medium of a metal, plastic, ceramics or the like, the application of ultraviolet rays and ozone is effected as the pre-treatment, and the surface of the recording medium is activated, whereby the attaching property of the ink can be improved. Also, in the case of a recording medium of plastic or the like which is liable to generate static electricity, dust is liable to attach to the surface thereof due to the static electricity and good recording may sometimes be hampered by the dust. Therefore, as the pre-treatment, the static electricity of the recording medium may preferably be removed by the use of an ionizer to thereby remove the dust from the recording medium. Also, when a fabric is used as the recording medium, the treatment of imparting a substance selected from among alkaline substances, water-soluble substances, synthetic high molecules, water-soluble metal salt, urea and thiourea to the fabric from the viewpoints of the prevention of oozing, the improved degree of exhaustion, etc. may preferably be done as the pre-treatment. The pre-treatment is not limited thereto, but may be the treatment of making the temperature of the recording medium appropriate for recording.

On the other hand, the post-treatment includes the heat treatment effected on the recording medium to which the ink has been imparted, the fixating treatment of expediting the fixation of the ink by the application of ultraviolet rays, the treatment of washing any treating agent imparted in the pre-treatment and left by non-reaction, etc.

In the present embodiment, the head has been described with respect to a full line head, whereas this is not restrictive, but the head may be in the form of a compact head as previously described which is conveyed in the widthwise direction of the recording medium to thereby effect recording.

In the liquid discharging method, etc. of the present invention, a fluid element comprised of a movable member and an air bubble producing area is provided upstream of a discharge energy generating element for discharging the liquid, and there is the effect that an air bubble is produced in the air bubble producing area in timed relationship with the driving of the liquid by the discharge energy generating element and with the air bubble, the free end side of the movable member is displaced into the liquid flow path to thereby suppress the flow in the upstream direction typified by a back wave and further, by the flow of the liquid accompanying the movement of the movable member when it is returned to its steady position with the disappearance of the air bubble in the air bubble producing area, the rapid refilling of the liquid from the upstream side to the discharge energy generating element can be achieved.

In the liquid discharging method of the present invention, a first air bubble producing area and a second air bubble producing area are provided and a movable member opened to the discharge port side by the pressure resulting from bubbling in the second air bubble producing area is provided, whereby there is provided the effect that the bubbling pressure in the second air bubble producing area is directed to the discharge port side and the discharge energy and protrusion pressure by the bubbling in the first air bubble producing area for liquid discharge are heightened and the discharge efficiency is improved. In this construction, there is also the effect that the influence of the back wave resulting from the bubbling in the first air bubble producing area can be prevented and coupled with the flow of the liquid when the movable member is returned to its initial position, rapid and stable refilling of the discharged liquid can be realized.

Also, a first liquid flow path having the first air bubble producing area and for effecting the discharge of the liquid and a second liquid flow path having the second air bubble producing area are made discrete from each other and the shape of the second liquid flow path is made into the shape of a chamber having a supply path, whereby the bubbling efficiency and the above-described effects can be further enhanced.

Further, there is the effect that a plurality of discharge energy generating elements are used in the first air bubble producing area, whereby the quantity of discharged liquid droplet can be controlled in a plurality of stages and harmonious recording or the like becomes possible.

What is claimed is:

1. A method for discharging liquid from a discharge port using a liquid jet recording head having said discharge port for discharging liquid, a liquid flow path communicating with said discharge port, a first heat generating area provided in said liquid flow path to apply thermal energy for discharging the liquid from said discharge port with bubble generation, a movable member provided upstream of said first heat generating area in said liquid flow path, wherein said movable member has a free end on said discharge port side, and a second heat generating area is provided facing said movable member, said movable member being shiftable upon the bubble generation at said second heat generating area, said method comprising the steps of:

generating the bubble at said second heat generating area and shifting said movable member so as to reduce a liquid communication area between said discharge port side and a liquid supply side that is upstream of said discharge port side;

moving the liquid to said discharge port side upon generation of the bubble in said first heat generating area while the bubble is generated in said second heat generating area; and moving said movable member so as to increase the liquid communication area between said discharge port side and the liquid supply side that is upstream of said discharge port side while the bubble is present in said first head generating area after the bubble is generated in said second heat generating area.

2. The method of claim 1, wherein the liquid at at least one said heat generating area is supplied with heat to cause a film boiling so as to generate the bubble.

3. The method of claim 1, wherein at least one of the bubbles generated by driving said heat generating areas is a bubble generated by a film boiling phenomenon.

4. The method of claim 1, wherein said second heat generating area is provided in a second flow path which is different from said liquid flow path and communicates with said liquid flow path through said movable member.

5. The method of claim 4, wherein the liquid supplied to said liquid flow path is different from that supplied to said second liquid flow path.

6. The method of claim 5, wherein the liquid supplied to said second liquid flow path has at least one of the following three properties; a viscosity lower than that of the liquid supplied to said liquid flow path, a bubbling characteristic greater than that of the liquid (supplied to said liquid flow path, and a heat stability higher than that of the liquid supplied to said liquid flow path.

7. The method of claim 1, wherein a plurality of said heat generating areas are provided and an amount of the liquid discharged from said discharge port is controlled by selectively driving said heat generating areas.

8. A method according to claim 1, wherein the bubble is generated at said second heat generating when the bubble is generated by driving said first heat generating area so that said free end of said movable member is shifted so that a cross-sectional area of the bubble in a flow direction of said liquid flow path is reduced compared with a stationary state.

9. A liquid discharge head for discharging a liquid, said head comprising:

a discharge port for discharging the liquid;

a liquid flow path communicating with said discharge port, a first heat generating area being provided in said liquid flow path to apply thermal energy for discharging the liquid from said discharge port with bubble generation; and a movable member provided upstream of said first heat generating area in said liquid flow path, wherein said movable member has a free end on said discharge port sides and a second heat generating area is provided facing said movable member, said movable member being shiftable upon the bubble generating at said second heat generating area, wherein when the bubble is generated at said second heat generating area the movable member is shifted so as to reduce a liquid communication area between said discharge port side and a liquid supply side that is upstream of said discharge port side;

wherein the liquid is moved to said discharge port side upon generation of the bubble in said first heat generating area while the bubble is generated in said second heat generating area, and wherein said movable member is moved so as to increase the liquid communication area between said discharge port side and the liquid supply side that is upstream of said discharge port side while the bubble is present in said first head generating area after the bubble is generated in said, second heat generating area.

10. The head of claim 9, wherein the liquid at at least one said heat generating area is supplied with heat to cause a film boiling so as to generate the bubble.

11. The head of claim 9, wherein at least one of said heat generating areas is an element for generating the bubble by a film boiling phenomenon by the driving of said heat generating area.

12. The head of claim 9, wherein said second heat generating area is provided in a second flow path which is different from said liquid flow path and which communicates with said liquid flow path through said movable member.

13. The head of claim 12, wherein the liquid supplied to said liquid flow path is different from that supplied to said second liquid flow path.

14. The head of claim 12, wherein the liquid supplied to said second heat generating area has at least one of the following three properties; a viscosity lower than that of the liquid supplied to said liquid flow path, a bubbling characteristic greater than that of the liquid supplied to said liquid flow path, and a heat stability higher than that of the liquid supplied to said liquid flow path.

15. The liquid discharging head of claim 12, wherein said second flow path is of a chamber shape to which a supply path is connected.

16. The head of claim 9, further comprising a plurality of heat generating elements.

17. The head of claim 9, wherein said movable member comprises a metal.

18. The liquid discharging head of claim 9, wherein said discharged liquid is ink used for recording.

19. A head according to claim 9, wherein the bubble is generated at said second beat generating area when the bubble is generated by driving said first heat generating area so that said free end of said movable member is shifted so that a cross-sectional area of the bubble in a flow direction of said liquid flow path is reduced compared with a stationary state.

20. A liquid discharging head cartridge comprising:

a liquid discharge head having;

a discharge port for discharging a liquid;

a liquid flow path communicating with said discharge port, a first heat generating area being provided in said liquid flow path to apply thermal energy for discharging the liquid from said discharge port with bubble generation; and a movable member provided upstream of said first heat generating area in said liquid flow path, wherein said movable member has a free end on said discharge port side, and a second heat generating area is provided facing said movable member, said movable member being shiftable upon the bubble generating at said second heat generating area, wherein when the bubble is generated at said second heat generating area the movable member is shifted so as to reduce a liquid communication area between said discharge port side and a liquid supply side that is upstream of said discharge port side;

wherein the liquid is moved to said discharge port side upon generation of the bubble in said first heat generating area while the bubble is generated in said second heat generating area, and wherein said movable member is moved so as to increase the liquid communication area between said discharge port side and the liquid supply side that is upstream of said discharge port side while the bubble is present in said first head generating area after the bubble is generated in said second heat generating area;

a liquid container holding therein the liquid to be supplied to said liquid discharging head; and liquid conveying means for conveying the liquid from the liquid container to the liquid discharge head.

21. The liquid discharging head cartridge of claim 20, wherein the liquid held in said liquid container is an ink.

22. An ink jet recording apparatus comprising:

a liquid discharge head for discharging a liquid, said head comprising:

a discharge port for discharging the liquid;

a liquid flow path communicating with said discharge port, a first heat generating area being provided in said liquid flow path to apply thermal energy for discharging the liquid from said discharge port with bubble generation; and a movable member provided upstream of said first heat generating area in said liquid flow path, wherein said movable member has a free end on said discharge port side, and a second heat generating area is provided facing said movable member, said movable member being shiftable upon the bubble generating at said second heat generating area, wherein said fluid resistance element generates the bubble at said second heat generating area and shifts the movable member so as to reduce a liquid communication area between said discharge port side and a liquid supply side that is upstream of said discharge port side;

wherein the liquid is moved to said discharge port side upon generation of the bubble in said first heat generating area while the bubble is generated in said second heat generating area, and wherein said movable member is moved so as to increase the liquid communication area between said discharge port side and the liquid supply side that is upstream of said discharge port side while the bubble is present in said first head generating area after the bubble is generated in said second heat generating area; and conveying means for conveying a recording medium past said liquid discharge head to receive the liquid discharged from said liquid discharge head.

* * * * *

UNITED STATES PATENT AND TRADEMARK OFFICE

CERTIFICATE OF CORRECTION

PATENT NO. : 6,213,592 B1
DATED : April 10, 2001
INVENTOR(S) : Masanori Takenouchi et al.

It is certified that error appears in the above-identified patent and that said Letters Patent is hereby corrected as shown below:

Title page,
Item [56], References Cited, U.S. PATENT DOCUMENTS,
"61-59914" should read -- 55-59914 --; and
"62-102945" should read -- 63-102945 --.

ABSTRACT,
Item [57], "discloses" should read -- disclosed --.

Column 1,
Line 15, "minutes" should read -- minute --;
Line 42, "are" should be deleted; and
Line 48, "are" should be deleted.

Column 2,
Line 14, "coped" should read -- cope --.

Column 4,
Line 38, "value" should read -- valve --; and
Line 40, "most time" should read -- most of the time --.

Column 5,
Line 67, "till" should read -- until --.

Column 6,
Line 43, "view-" should read -- view --.

Column 7,
Line 14, close up right margin;
Line 15, close up left margin; and
Line 51, "as" should read -- an --.

Column 8,
Line 30, "than the movable member" should be deleted.

Column 10,
Line 39,"ethyether," should read -- ethyl ether, --;
Line 41,"mixtured" should read -- mixtures --; and
Line 47, "cowhide" should read -- cowhide, --.

UNITED STATES PATENT AND TRADEMARK OFFICE

CERTIFICATE OF CORRECTION

PATENT NO. : 6,213,592 B1
DATED : April 10, 2001
INVENTOR(S) : Masanori Takenouchi et al.

It is certified that error appears in the above-identified patent and that said Letters Patent is hereby corrected as shown below:

Column 13,
Line 45, "hearer" should read -- heater --.

Column 18,
Line 48, "properties;" should read -- properties: --;
Line 50, "(supplied" should read -- supplied --; and
Line 58, "generating" should read -- generating area --.

Column 19,
Line 7, "sides" should read -- side, --;
Line 24, "head" should read -- heat --;
Line 25, "said," should read -- said --;
Line 42, "properties;" should read -- properties: --;
Line 57, "beat" should read -- heat --; and
Line 64, "having;" should read -- having: --.

Column 20,
Line 14, "side;" should read -- side, --;
Line 23, "head" should read -- heat --; and
Line 51, "side;" should read -- side, --.

Signed and Sealed this

Twenty-sixth Day of February, 2002

*Attest:*

*Attesting Officer*

JAMES E. ROGAN
*Director of the United States Patent and Trademark Office*